US011091298B2

(12) United States Patent
Shahesmaeili

(10) Patent No.: US 11,091,298 B2
(45) Date of Patent: Aug. 17, 2021

(54) THREAD SUPPORT MEMBER FOR CLOSURES

(71) Applicant: WSM BVBA, Ghent (BE)

(72) Inventor: Seyed Mostafa Shahesmaeili, Sint-Denijs-Westrem (BE)

(73) Assignee: WSM BVBA, Sint-Denijs-Westrem (BE)

( * ) Notice: Subject to any disclaimer, the term of this patent is extended or adjusted under 35 U.S.C. 154(b) by 90 days.

(21) Appl. No.: 15/763,456

(22) PCT Filed: Sep. 30, 2016

(86) PCT No.: PCT/EP2016/073457

§ 371 (c)(1),
(2) Date: Mar. 27, 2018

(87) PCT Pub. No.: WO2017/055574

PCT Pub. Date: Apr. 6, 2017

(65) Prior Publication Data

US 2018/0273253 A1 Sep. 27, 2018

(30) Foreign Application Priority Data

Oct. 2, 2015 (BE) ..... 2015/5612
Oct. 2, 2015 (EP) ..... 15188114

(51) Int. Cl.
*B65D 41/04* (2006.01)
*B65D 51/16* (2006.01)
(Continued)

(52) U.S. Cl.
CPC ..... *B65D 41/0485* (2013.01); *B65D 1/0246* (2013.01); *B65D 41/04* (2013.01);
(Continued)

(58) Field of Classification Search
CPC .... B65D 41/0485; B65D 41/04; B65D 51/16; B65D 1/0246; B65D 51/1688; B65D 51/245; B65D 2251/02; B65D 2251/023
(Continued)

(56) References Cited

U.S. PATENT DOCUMENTS

D90,246 S * 7/1933 Hall ..... D9/451
3,110,599 A 11/1963 Kusinski et al.
(Continued)

FOREIGN PATENT DOCUMENTS

GB 189912520 4/1900
WO 2005075312 A1 8/2005

OTHER PUBLICATIONS

PCT International Search Report and Written Opinion dated Jan. 4, 2017 for PCT International Patent Application No. PCT/EP2016/073457, 16 pages.

*Primary Examiner* — James N Smalley
(74) *Attorney, Agent, or Firm* — Amster Rothstein & Ebenstein LLP

(57) ABSTRACT

A closure (100) comprising a top wall portion (102), a thread support member (108) extending from said top wall portion disposed with a thread (124), and at least one discrete recess (112) provided on said thread support member. The discrete recess may extend below a surface of and through said thread support member so as to form a fenestration, wherein said fenestration is configured for passage of flowable matter. The thread support member may be provided with a subregion limited by ends of said thread wherein said at least one discrete recess is provided at least partially within said subregion. The discrete recess may be formed as a three dimensional marking.

28 Claims, 12 Drawing Sheets

(51) Int. Cl.
*B65D 51/24* (2006.01)
*B65D 1/02* (2006.01)

(52) U.S. Cl.
CPC ..... *B65D 51/16* (2013.01); *B65D 51/1688* (2013.01); *B65D 51/245* (2013.01); *B65D 2251/02* (2013.01); *B65D 2251/023* (2013.01)

(58) Field of Classification Search
USPC ..... D9/435; 215/230
See application file for complete search history.

(56) References Cited

U.S. PATENT DOCUMENTS 3,413,743 A * 12/1968 Goodhue ..... B65D 51/245 40/311
4,469,235 A * 9/1984 Parker ..... B65D 41/0485 215/295
4,742,929 A * 5/1988 Desai ..... B65D 41/04 215/332
4,761,319 A * 8/1988 Kraus ..... B62D 25/24 220/787
4,883,194 A * 11/1989 Fernandes ..... B65D 39/08 220/787
5,938,055 A * 8/1999 Philips ..... B65D 41/06 215/222
6,202,871 B1 3/2001 Kelly
6,382,440 B1 * 5/2002 Brant ..... B65D 51/245 206/459.1
D481,316 S * 10/2003 Hook ..... D9/435
D494,064 S * 8/2004 Hook ..... D9/435
2007/0257069 A1 11/2007 Gibson et al.

* cited by examiner

THREAD SUPPORT MEMBER FOR CLOSURES

CROSS-REFERENCE TO RELATED APPLICATIONS

This application is a U.S. national stage entry under 35 U.S.C. § 371 of PCT International Patent Application No. PCT/EP2016/073457, filed Sep. 30, 2016, which claims priority to European Patent Application No. 15188114.1, filed Oct. 2, 2015 and Belgian Patent Application No. 2015/5612, filed Oct. 2, 2015.

FIELD OF THE INVENTION

The present invention is in the field of threaded closures. The application for container closures is particularly interesting.

BACKGROUND TO THE INVENTION

Manual opening of a conventional threaded closure can be challenging and unpleasant due to multiple reasons. The opening of a threaded closure requires significant force which comprises both a lateral pressure on the sidewall or handle of the closure for grip, and a torsional force for the actual unscrewing of the closure. The amount of grip on the closure is not only determined by the applied lateral force, but also by the size and shape of the surface area of the closure sidewall or handle thereon. A threaded closure has a top wall portion, a thread support member and a thread. The thread support member is an annular skirt extending from the top wall portion and supporting the thread. When the thread is located on the inner surface of the thread support member, the outer surface of the thread support member can function as a manipulation surface for receiving torque e.g. tightening or opening of the closure. It is understood that the thread may be located on an outer surface of the thread support member, in such case the cylindrical wall of the closure may not necessarily function as a manipulation surface; a handle may be provided to achieve this function. Most currently available threaded closures have gripping protrusions on their thread support member or handle. These elements are intended to increase friction, and thus decrease the required amount of lateral force. Most often these gripping protrusions are fine, numerous, and longitudinally placed because aforementioned properties contribute to increasing the grip. Because these gripping protrusions are placed additionally on the closure, this requires the use of a significant amount of additional material when producing such closures. Most closures are made of plastics such as high density polyethylene, low density polyethylene, polypropylene and the like. The use of aforementioned materials is not environmentally friendly.

Because of the presence of gripping protrusions on closures, manipulation of these closures is often experienced as unpleasant. This is amongst others because pressing fingers with a relatively high force on the ridges of the gripping protrusions causes discomfort. This perceived discomfort is one of the reasons why most closures of cosmetic products do not have gripping protrusions. Most companies that produce cosmetics avoid any factor such as gripping protrusions that could decrease the pleasant experience of the consumer (e.g. smooth feel of the product). The unpleasant feeling when manipulating a closure with gripping protrusions is among others due to the activation of pressure sensors in the fingertips by the gripping protrusions.

The amount of necessary force and turning speed to open or close a threaded closure depend among others on the mass of the closure. More specifically the mass of the thread support member is important because this component has the largest movement. A closure with a thread support member that has a high mass requires a high turning force. A high mass of the thread support member also limits the turning speed of the closure. A high turning force and low turning speed make the overall manipulation of the closure difficult and unpleasant.

A problem with currently available threaded closures is that there is no visual indication to which extent the closure is open or closed. This has to be checked manually, which is laborious and time-consuming.

There is a critical margin between the dimensions of a threaded closure and the receiving neck in order to have a proper fit between these two components. The critical margin for a proper fit for currently available threaded closures is small because the thread support member is stiff and generally non-complaint. As a result of this many produced closures are discarded because they do not fit the strict dimensions. This not only leads to a decrease in production volume, but it also increases the amount of waste.

Threaded closures can become lodged on the receiving neck when they are applied with significant torque (e.g. capping at a factory site). A stiff thread support member increases the chance for a closure to become lodged, and it can only be released with much effort and force because of the retaining forces between the closure and the receiving neck.

The total cost for the production of threaded closures comprises energy and an amount of material. The cost of the amount of used material is greater than the cost of energy. Therefore any reduction of the amount of used material has a significant effect on the total production cost of closures. A reduction of the amount of used material cannot be performed haphazardly because this can result in a loss of function and quality. Beside economical considerations, also as a result of increasingly strict ecological regulations, the use of large quantities of plastics is discouraged.

A problem with currently available threaded closures is that because of the large volume and limited surface area of the thread support member there is no efficient heat dissipation. Closures made of synthetic materials are most commonly produced by injection moulding. The production speed with injection moulding depends on the cycle time which comprises an injection phase, a cooling phase and an ejection phase. The duration of the cooling phase is the most important determinant of the cycle time because it is longer than the other phases combined. Because the thread support member as a component of the closure has the largest volume and surface area, it is the most important determinant for heat dissipation. Because of this the thread support member is the limiting factor for the duration of the cooling phase and thus the cycle time and production speed. An efficient heat dissipation is not only important for a high production speed, but also thereafter. After closures are fabricated they are usually stacked on top of each other, which can lead to deformation of some of the closures. One reason for the problem of deformation is that currently available closures do not dissipate heat fast enough during the second cooling phase after ejection. The higher the temperature of the closure when it is stacked, the more it is prone to deformation. Because of the large volume and limited surface area of the thread support member of currently available closures deformation occurs very frequently.

Beside economical and ecological considerations regarding the production of threaded closures, the use of extra material for the gripping protrusions increases the mass of the closure substantially. This increase of mass makes transport (such as from the production facility of the closure to the filling plant of containers, from the filling plant of containers to the wholesaler, from the wholesaler to the supermarkets, from the supermarkets to the consumer, from the consumer to the garbage facilities, etc.) more expensive and energy consuming.

Beside the transport cost for heavy closures there is much energy required for the processing and recycling of these closures. For example much energy is needed for the shredding of these closures because of their stiff thread support member.

When opening a pressurized container (e.g. when the content is a carbonated liquid), there is an escape of gas. Because the gas cannot escape smoothly with currently conventional closures, consumers take extensive time and open the cap very slowly.

Companies distinguish theirselves amongst others through trademark features of their closures. This can include a specific shape, color and size of a closure. Most companies display text, logos, advertising, etc. on the circular top wall portion of their closures. This is not an efficient way of communication because the top portion of the container closure is not clearly visible when it is in an upright position (as is the case most of the time, such as on the shelves of supermarkets, in refrigerators, etc.). Although the thread support member of container closures is more clearly visible when containers are in an upright position, currently it is not possible to display communication on the thread support member because of the necessity of gripping protrusions.

Currently available threaded closures cannot be identified easily purely visually (by machine or human) because they look identical from all angles of rotation. This poses a problem not only for the processing of closures, but also for the processing of containers on which a closure is mounted. Containers are usually identified by the two dimensionally printed label that is adhered to it. This only allows visual identification, and can pose a problem for the visually impaired, or when there is no visual identification possible (e.g. in the dark). Although labels are used frequently and can usually be read easily by humans, this is not always the case for machines. Because the label is printed using a two dimensional printer, camera identification is often very challenging.

The act of pouring from a container fitted with a conventional threaded closure can be challenging, laborious, and inefficient due to multiple reasons. The action of pouring from containers with currently conventional threaded closures comprises minimally of six phases: opening the closure, lifting the container, tilting forth the container (actual pouring), tilting back the container, putting back the container, and closing the cap. The closure has to be unscrewed and taken off entirely in order to have access to the content. This is laborious and tedious, and the detached closure may be misplaced. During the tilting forth and tilting back phases the container must be angled attentively and accurately to avoid spillage and control the flow speed. Because the speed of content outflow is only determined by changes in the tilting angle there is no accurate control of flow speed. The tilting forth and tilting back phases must be repeated multiple times to appropriately assess the poured volume. Each repetition of tilting forth and tilting back increases the risk of spillage. Particularly the tilting forth and tilting back phases require adequate upper body strength meaning certain population groups are unable to properly pour. In containers with currently conventional closures the content does not exit in a steady and even flow, but in a series of abrupt "glugs". The glugging destabilizes manual support of the container, and also causes splattering, so making steady pouring and spillage avoidance difficult.

The neck of almost all currently conventional containers is cylindrical, which can offer only one flow pattern. In order to achieve a different flow pattern a separate flow modifier needs to be mounted. A separate flow modifier is cumbersome and makes the act of pouring more complex due to the presence of an extra component. There is also an additional cost and effort to acquire a flow modifier, and they require cleaning and protective storage.

There are instances where the maximum flow speed needs to be reduced in order to allow a better dosing of the content (e.g. edible oils). To achieve this presently a separate flow speed modifier is required. Usually this is a component that is attached to the container under the closure. Because a separate component is required this increases the production time, the production cost and complexity of the entire process. Usually such flow speed modifiers are attached non-dismountably to the container which restricts the pouring possibilities for the user.

Often the content of a container needs to be filtered. In order to achieve this presently a separate filter has to be used. A separate filter is cumbersome, and makes the act of pouring more complex due to the presence of an extra component. There is also an additional cost and effort to acquire a separate filter, and they require cleaning and protective storage.

For some liquids aeration can enhance the properties of the liquid. For example wine aerators improve the aeration and hence the taste of wine. A separate aerator is cumbersome, and makes the act of pouring more complex due to the presence of an extra component. There is also an additional cost and effort to acquire an aerator, and they require cleaning and protective storage.

There are instances where the properties of the content needs to be enhanced (e.g. add vitamins, kill bacteria, enhance flavour, etc.). The currently available methods require adding a separate element to the closure which has to be activated. Because a separate element has to be added to the closure this increases the production cost of the closure tremendously.

U.S. Pat. No. 6,253,942 B1 and U.S. Pat. No. 6,811,047 B1 are attempts to create smooth large handles which give sufficient grip so there is no need for gripping protrusions, but they have multiple disadvantages. The production of these large handles requires an amount of material that is significantly larger than the necessary amount for conventional gripping protrusions. This increases the production and transport costs of these closures. Another disadvantage of large handles is that they can distort the design of the container and make them look less sleek. The presence of large handles on container closures can make the stacking, storing and handling of these containers more challenging.

GB 189912520 A, U.S. Pat. No. 1,207,560 A, U.S. Pat. No. 4,469,235 A, U.S. Pat. No. 4,534,477 A, U.S. Pat. No. 4,731,512 A, U.S. Pat. No. 5,184,740 A, and US 20140263317 A1 are attempts to replace the gripping protrusions on the thread support member of closures by longitudinally protruding manipulation handles on the top wall portion of closures, but they have multiple disadvantages. The necessity of a minimum length for these elements to allow easy manipulation by hand results in the use of a significant amount of material which is comparable or larger than the necessary amount for conventional gripping protrusions. Another disadvantage of longitudinal handles is that they can distort the design of the container and make them look less sleek. The presence of longitudinal handles on container closures can make the stacking, storing and handling of these containers more challenging.

There are multiple inventions which have tried to create a smooth outflow of gas when opening a container, something which is particularly interesting when opening a pressurized container. Among these inventions are interrupted threads, such as described in patents U.S. Pat. No. 4,643,330 A, EP 0263699 B1, U.S. Pat. No. 6,006,930 A, and US 20120091138 A1, but they have multiple disadvantages. These interrupted threads can be either on the container neck, the closure or both. Although interrupted threads allow a larger outflow of gas compared to continuous threads, the outflow of gas is still limited and not smooth. Another disadvantage of interrupted threads is that the total thread surface area is diminished, which causes a decrease in the retention force of the closure. If the overall length of the thread is made longer to compensate this decrease of retention force, a redesign of the neck of the container or the closure thread support member might be necessary.

US 20100200532 A1 is an attempt to decrease the necessary amount of used material for the production of threaded closures while retaining most of its functions and strengths, but it has multiple disadvantages. In patent US 20100200532 A1 the thread support member of the closure is corrugated. In order for these corrugations to provide sufficient grip, they must be plentiful and have sharp edges. As a consequence, one of the disadvantages of this invention is that pressing fingers on the corrugated surface area is uncomfortable and does not provide a smooth feel. Although it is suggested that when the thread support member is corrugated this will result in a decrease of the necessary amount of used material for the production of closures, this decrease of material and mass is very limited. By adding corrugations to the thread support member, this increases the surface area and thus also the total volume of the thread support member. Although gripping protrusions are omitted, and in this sense there is a decrease in the necessary amount of material, there is an increase of the volume of the thread support member. Consequently the amount of saved material compared to gripping protrusions is limited. Another disadvantage is that a corrugated thread support member limits the design possibilities of a closure and can make the overall look of the closure less appealing.

U.S. Pat. No. 3,110,599 A, U.S. Pat. No. 6,202,871 B1 and EP 2208684 A1 each disclose a closure with a cylindrical shell that has windows, but they have many disadvantages. These windows are not located on the threaded portion of the cylindrical shell of the closure (subregion of the thread support member), but on the unthreaded transitional portion from the top wall to the subregion of the thread support member disposed with the thread. Because the unthreaded transitional portion from the top wall to the subregion has a small volume the windows cause only a very limited overall volume and mass reduction of the closure. Because the unthreaded transitional portion from the top wall to the subregion of the thread support member has a relatively small surface area this limits the size and shape of the windows. This not only restricts the design possibilities of the windows, and makes it very difficult to clearly portray visual communication, but small windows also do not allow fast and efficient venting. Most currently available threaded closures have sealing rims attached to the top wall. These sealing rims obstruct windows located in the unthreaded transitional portion from the top wall to the subregion of the thread support member, and thus don't allow efficient venting. Because the windows on the unthreaded transitional portion from the top wall to the subregion of the thread support member can only have a limited surface area they cannot function as gripping surfaces, and additional gripping protrusions are necessary.

U.S. Pat. No. 3,199,702 A and FR 2578513 A1 each disclose a closure with a cylindrical shell that has windows, however, these windows are not located on the threaded portion of the cylindrical shell of the closure (subregion of the thread support member), but on an unthreaded additional protective collar that extends axially from the cylindrical shell of the closure. Because the protective collar extending from the cylindrical shell of the closure has a relatively small volume the windows cause only a very limited overall volume and mass reduction of the closure. Another disadvantage of these types of closures is that the protective collar requires an adaptation of the receiving neck. The neck usually has to be adjusted to have additional projecting shoulders to accommodate the protective collar. This addition of an extra element both to the closure as well as to the receiving neck makes the production more time consuming and complex.

Closures according to EP 0622305 A1 have windows in the cylindrical shell that makes up the closure, but they have many disadvantages. A disadvantage of this type of closure is that they lack a thread and operate by means of click-fastening. To open the closure a large resistance has to be overcome. This can cause the closure to dart out and cause spilling. Aforementioned elements make manipulation of this type of closure unpleasant. Because the windows in the cylindrical wall have to fit the clips on the neck of the container this limits the design possibilities and makes it impossible to portray visual communication through these windows. Because the clips occupy the space within the windows of the cylindrical wall, opening this type of closure can be dangerous and cause lesions to the fingers.

Closures according to EP 2594504 A1 also have windows in the cylindrical shell that makes up the closure, but they have many disadvantages. A disadvantage of closures according to EP 2594504 A1 is that they have multiple components, and only the internal component of the closure has windows. This makes these closures heavy, complex, expensive and time consuming to produce. Because only the internal component of the closure has windows the weight reduction as a cause of the windows is very limited, it is not possible to portray visual communication on the cylindrical shell of the closure, the windows cannot be used as gripping surfaces, and the windows cannot be used to pour content out of. The fact that the windows according to EP 2594504 A1 are always configured in a helical geometry and always have inwards projecting tabs limits the design possibilities tremendously. Because only the internal component of the closure has windows, the windows do not allow a passage of gas. Furthermore the cylindrical shell of the internal component of the closure which has windows lacks a thread which makes the sealing capability less reliable and manipulation unpleasant.

There is a need in the art for a lightweight closure which has a smooth feel while offering sufficient grip, which allows gas to escape more smoothly, and is able to portray visual communication on its thread support member.

There is a need in the art for a lightweight closure which requires less force for turning, which can be turned at a higher speed, which has a visual indication of the extent of closure, which has a large critical margin for a tight fit, which has less risk to become lodged on the receiving neck, which can be released more easily in case it becomes lodged, which has a faster and more efficient heat dissipation, which can be produced at a higher speed, which can be disintegrated and recycled more easily, which allows communication of information that can be perceived multisensorially (e.g. visual, sensory etc.), which allows communication of information with an improved machine readability, which allows gradual control of content flow, which allows an accurate continuous assessment of the poured volume during pouring, which can act as a dismountable flow pattern modifier, which can act as a dismountable flow speed modifier, which can act as a dismountable particle filter, which can act as an aerator, and which can enhance the property of the content during pouring.

SUMMARY OF THE INVENTION

A first aspect of the present invention relates to a closure (100) comprising a top wall portion (102), a thread support member (108) extending from said top wall portion (102) disposed with a thread (124), and at least one discrete recess (112) provided on the thread support member (108), wherein said discrete recess (112) extends below a surface of the thread support member (108).

The at least one discrete recess (112) may extend through the thread support member (108) so as to form a fenestration configured for passage of flowable matter. Said thread support member may be provided with a subregion limited by ends of said thread wherein said at least one discrete recess is provided at least partially within said subregion.

The at least one discrete recess (112) may extend through the thread support member (108) so as to form a fenestration configured for passage of gas.

The at least one discrete recess (112) may be configured to reduce the weight of the closure (100) without a decrease of function of the thread support member (108). The thread (124) may be disposed on an inner surface (104) of the thread support member (108).

The at least one discrete recess (112) may be configured to increase grip.

The thread (124) may be disposed on an outer surface (106) of the thread support member (108).

The closure (100) may further comprise a manipulation element which is disposed on the top wall portion (102) and configured for the application of torque.

The at least one discrete recess (112) may be formed as a visual marking.

The closure (100) may be formed substantially from a polymeric material.

The closure (100) may be for an artifact such as a container, and the top wall portion (102) configured to sealingly co-operate with an opening of the artifact.

The closure (100) may be provided with at least two discrete recesses (112) each formed as a fenestration and each disposed at a different position on the thread support member relative to the top wall portion.

The thread (124) may be continuous and configured to contribute to the mechanical strength of said thread support member (108).

The at least one discrete recess (112) formed as a fenestration may be further formed as a three-dimensional marking.

The three-dimensional marking may be configured for visual and/or tactile identification.

The at least one discrete recess (112) formed as a fenestration may be configured to decrease the required torque for said closure (100).

The at least one discrete recess (112) formed as a fenestration may be configured to allow direct visibility of said thread (124).

The at least one discrete recess (112) formed as a fenestration may be configured for gradual control of content flow.

The at least one discrete recess (112) formed as a fenestration may be configured as a flow modifier.

The at least one discrete recess (112) formed as a fenestration may be configured as a particle filter.

The at least one discrete recess (112) formed as a fenestration may be configured to improve the heat dissipation capacity of the closure (100).

The quantity of discrete recesses (112) formed as fenestrations provided within the subregion may be 1-5, 5-30, 10-20, more than or equal to 12.

A further aspect described herein relates to a closure (100) comprising a top wall portion (102), a thread support member (108) extending from said top wall portion (102) disposed with a thread (124), and at least one discrete recess (112) provided on the thread support member (108), wherein said discrete recess (112) extends below a surface of the thread support member (108) and is formed as a three dimensional marking.

The at least one discrete recess (112) formed as a three dimensional marking may be configured for visual and/or tactile identification.

The at least one discrete recess (112) may be configured to reduce the weight of said closure (100) without a decrease of function of said thread support member (108).

The thread (124) may be disposed on an inner surface (104) of said thread support member (108).

The at least one discrete recess (112) may be configured to increase grip.

The thread (124) may be disposed on an outer surface (106) of said thread support member (108).

The closure (100) may further comprise a manipulation element disposed on said top wall portion (102), configured for the application of torque.

The at least one discrete recess (112) may be configured to decrease the required torque for said closure (100).

The closure (100) may be formed substantially from a polymeric material.

The closure (100) may be for an artifact such as a container, and said top wall portion (102) may be configured to sealingly co-operate with an opening of the artifact.

The thread support member (108) may be provided with a subregion limited by ends of the thread wherein the at least one discrete recess formed as a three-dimensional marking is provided at least partially within the subregion.

FIGURE LEGENDS

DETAILED DESCRIPTION OF INVENTION

Figure 1:
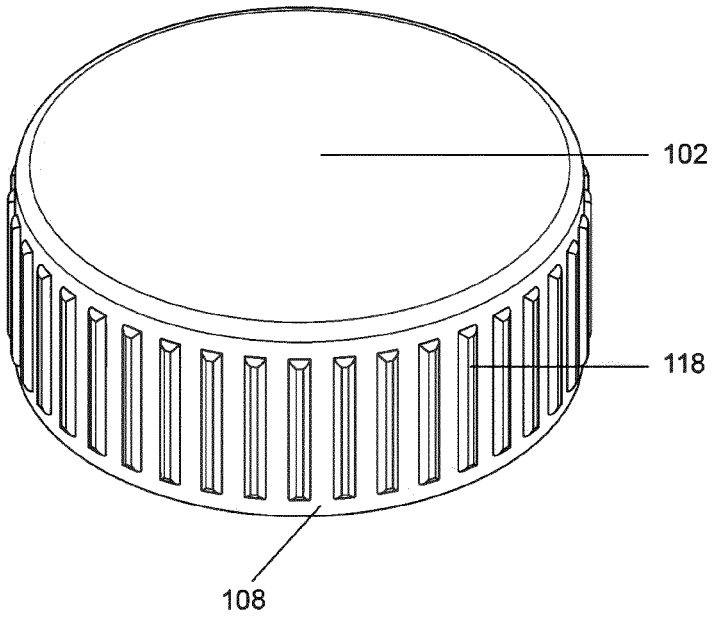
FIG. 1 is a schematic illustration of a threaded closure with longitudinally placed rectangular gripping protrusions as is currently available in the art.

Before the present system and method of the invention are described, it is to be understood that this invention is not limited to particular systems and methods or combinations described, since such systems and methods and combinations may, of course, vary. It is also to be understood that the terminology used herein is not intended to be limiting, since the scope of the present invention will be limited only by the appended claims.

As used herein, the singular forms "a", "an", and "the" include both singular and plural referents unless the context clearly dictates otherwise.

The terms "comprising", "comprises" and "comprised of" as used herein are synonymous with "including", "includes" or "containing", "contains", and are inclusive or open-ended and do not exclude additional, non-recited members, elements or method steps. It will be appreciated that the terms "comprising", "comprises" and "comprised of" as used herein comprise the terms "consisting of", "consists" and "consists of".

The recitation of numerical ranges by endpoints includes all numbers and fractions subsumed within the respective ranges, as well as the recited endpoints.

The term "about" or "approximately" as used herein when referring to a measurable value such as a parameter, an amount, a temporal duration, and the like, is meant to encompass variations of +/−10% or less, preferably +/−5% or less, more preferably +/−1% or less, and still more preferably +/−0.1% or less of and from the specified value, insofar such variations are appropriate to perform in the disclosed invention. It is to be understood that the value to which the modifier "about" or "approximately" refers is itself also specifically, and preferably, disclosed.

Whereas the terms "one or more" or "at least one", such as one or more or at least one member(s) of a group of members, is clear per se, by means of further exemplification, the term encompasses inter alia a reference to any one of said members, or to any two or more of said members, such as, e.g., any ≥3, ≥4, ≥5, ≥6, ≥7, etc. of said members, and up to all said members.

All references cited in the present specification are hereby incorporated by reference in their entirety. In particular, the teachings of all references herein specifically referred to are incorporated by reference.

Unless otherwise defined, all terms used in disclosing the invention, including technical and scientific terms, have the meaning as commonly understood by one of ordinary skill in the art to which this invention belongs. By means of further guidance, term definitions are included to better appreciate the teaching of the present invention.

In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to a person skilled in the art from this disclosure, in one or more embodiments. Furthermore, while some embodiments described herein include some but not other features included in other embodiments, combinations of features of different embodiments are meant to be within the scope of the invention, and form different embodiments, as would be understood by those in the art. For example, in the appended claims, any of the claimed embodiments can be used in any combination.

In the present description of the invention, reference is made to the accompanying drawings that form a part hereof, and in which are shown by way of illustration only of specific embodiments in which the invention may be practiced. Parenthesized or emboldened reference numerals affixed to respective elements merely exemplify the elements by way of example, with which it is not intended to limit the respective elements. It is to be understood that other embodiments may be utilized and structural or logical changes may be made without departing from the scope of the present invention. The following detailed description, therefore, is not to be taken in a limiting sense, and the scope of the present invention is defined by the appended claims.

The present invention relates to threaded closures. The closure is for an artifact such as a container. The closure is preferably for sealing a container, in particular a container opening. A threaded closure according to the invention comprises a top wall portion and a threaded thread support member extending from the top wall portion that engages with a complementary thread of the artifact such as a container. The thread support member connects the thread of a closure with its top wall portion.

The thread support member may be provided with a 'subregion' that is a region of the thread support member limited by ends of the thread. One end of the subregion corresponds to a terminal end of the thread towards the open end of the closure, while the other end corresponds to a terminal end of the thread towards the closed end of the closure. The subregion typically has a cylindrical geometric form. According to one aspect of the invention, the at least one discrete recess is provided at least partially optionally fully within the aforementioned subregion. Where there are a plurality of discrete recesses, they may all be provided within the subregion. Where there are a plurality (a certain quantity more than 2) of threads, there may be a corresponding quantity of subregions.

The thread support member, preferably the subregion thereof, comprises at least one discrete recess—a void volume below a surface of the thread support member—that may partially or fully extend through a wall of the thread support member. A discrete recess that fully extends through a wall of the thread support member is referred to as a fenestration. A discrete recess decreases the weight of the closure, offers a gripping surface (in the case of an internal thread) while retaining the smooth feel of a closure, allows a smooth passage of flowable matter, for instance liquid or gas (in the case of fenestrations), and/or allows to portray visual communication on the thread support member.

When the thread is located on the inner surface of the thread support member, the outer surface of the thread support member can function as a manipulation surface for receiving torque e.g. tightening or opening of the closure. It is understood that the thread may be located on an outer surface of the thread support member, in such case the cylindrical wall of the closure may not necessarily function as a manipulation surface; a handle may be provided to achieve this function. Such handle may be hollow and in continuation with the internal void space of the thread support member so as to form an extension of the top wall portion (see for example FIGS. 15-16).

Embodiments of the invention make a closure lightweight without loss of function (e.g. no change in retention force, comparable durability, etc.). The decrease of mass is achieved by omitting or decreasing gripping protrusions, and by reducing the material volume of the thread support member. This decrease of mass decreases the production and transport costs, and makes these closures more ecological. Embodiments of the invention offer an increased grip (in the case of an internal thread) because of the possibility to have gripping surfaces in multiple directions (e.g. longitudinal, perpendicular). Embodiments of the invention (in the case of an internal thread) offer a smooth feel of the closure because the fingers are firstly in contact with the smooth surface of the thread support member, and gripping protrusions are not necessary. Because of the possibility to have a smooth surface with embodiments of the invention, visual markings can be portrayed on the thread support member (e.g. advertising, expiry dates). Such markings are also machine-readable. The visual content may be displayed on the smooth parts of the thread support member (e.g. printing), but it can also be portrayed indelibly by changing the form of the discrete recesses accordingly. When the discrete recesses of embodiments of the invention are fenestrations, these fenestrations allow a smooth passage of flowable matter, for instance liquid or gas. This has particular utility for pressurized containers (e.g. carbonated liquids). When the discrete recesses of embodiments of the invention are numerous large fenestrations (in the case of an internal thread), the working mechanism of the threaded closure is visible, which makes the design appealing, and allows distinction and recognition to a product.

Closure embodiments of the invention may be used in a stand-alone container, but may also be integrated into other systems, for instance in engines or machines, catering systems, engineering systems, healthcare systems, agricultural systems, in any system where there is a need for a threaded closure.

The top wall portion is an end portion of the closure, and is connected to the thread support member. It is preferably circular in shape, and acts as an occluding surface when it is pressed onto a container opening. The top wall portion is configured to sealingly co-operate with an opening of an artifact, such as a container. In the sealed condition the top wall portion is configured to seal, preferably fluidically seal the opening to prevent the passage of material into or out of the container. It may further offer protection from the environment (protective barrier). The inner side of the top wall portion which is pressed on the container opening can comprise additional material or elements, which can be different from the material of the closure, and can help to achieve a more hermetic seal. The skilled person will understand that the most suitable material dimensions, wall thickness and form of the top wall portion depend on the content and the usage, and understands how to suitably configure this accordingly.

The thread support member extends away from the top wall portion. The thread support member is effectively attached at one end to the top wall portion, and may be open at an other end. There may be an unthreaded transitional portion between the top wall portion and the threaded subregion of the thread support member. The thread support member comprises a body having preferably an annular form. In particular the thread support member comprises a body that is hollow and cylindrical. It has an inner surface (see for instance FIGS. 4, 9, 12, 14, and 16; 104 inner surface) and an outer surface (see for instance FIGS. 4, 9, 12, 14, and 16; 106 outer surface). The outer surface may be substantially smooth. The outer surface may be provided with one or more protrusions; they may enhance manual grip. The thickness is the material thickness between the inner and outer surface. The inner surface or the outer surface may be threaded.

The thread support member may be disposed with at least one discrete recess. The at least one discrete recess may be disposed on the inner and/or outer surface of the thread support member. The at least one discrete recess extends below the inner and/or outer surface of the thread support member. The discrete recess may extend partially through the thread support member, in particular through the body thereof. The discrete recess may extend fully through the thread support member, connecting the inner surface with the outer surface. Such a discrete recess may be termed a fenestration. The discrete recess may further extend partially or fully through the thread. The discrete recess may be provided at least partially optionally fully within aforementioned subregion.

By referring to a recess as discrete, it is meant that a recess can be distinguished from a body of the thread support member or from another discrete recess. Where there is a plurality of discrete recesses, they are spatially separated. Where there are a plurality of discrete recesses they may all be provided at least partially optionally fully (i.e. entirely) within aforementioned subregion.

It is noted that a discrete recess may not be merely a serration or corrugation that is formed by raising a region of the thread support member adjacent to or surrounding the recess. The term "recess" preferably means that a part of the thickness of the thread support member is effectively removed. The presence of a recess leads to a reduction in the weight of the closure. The reduction in weight is compared to when the recess is absent.

The skilled person will appreciate that the shape, size and number of discrete recesses may be chosen freely, and understands how to suitably configure this according to the needs. The quantity of discrete recesses provided at least partially, optionally fully within the subregion may be 1-5, 1-40, 1-100, 5-30, 10-20, or more than or equal to 12. The quantity of discrete recesses provided at least partially, optionally fully within the subregion may be 1-40.

There may be a plurality of discrete recesses wherein said discrete recesses are separated by a difference in position to the top wall. There may be a plurality of discrete recesses wherein said discrete recesses are separated by a difference in position on the circumference of the thread support member. In case the plurality of discrete recesses are only separated by a difference in position on the circumference of the thread support member the discrete recesses may be separated by pillars or pillar-shaped elements (see for example FIGS. 5, 6, 7, 15 and 16). There may be a plurality of discrete recesses aligned on the thread support member along a longitudinal axis parallel to an axis of rotation of the closure. The plurality of discrete recesses may be of similar size and/or shape and/or orientation, and they may be mutually aligned on the thread support member along a longitudinal axis parallel to an axis of rotation of the closure (see for instance FIGS. 2-4). A discrete recess may have a slot-like form, an orientation of the slot being divergent from a helical angle of the thread. In the case of a plurality of discrete recesses at least two of them, optionally all of them may have similar or different characteristics. These characteristics include but are not limited to the position relative to the top wall portion, the position on the circumference of the thread support member, the alignment on a longitudinal axis parallel to an axis of rotation of the closure, the size, the shape, and the orientation. The skilled person can appreciate that aforementioned characteristics determine many of the characteristics of the closure, and understands how to suitably configure this according to the needs.

According to one aspect, the closure may be provided with at least two discrete recesses each optionally formed as a fenestration and each disposed at a different position on the thread support member relative to the top wall portion. The different positions may be determined according to a position of central point of the respective recesses. The at least two discrete recesses may both be provided on the same axis parallel to the axis of rotation of the closure e.g. separated axially. The at least two discrete recesses may each be provided on different axes parallel to the axis of rotation of the closure e.g. separated circumferentially.

The edges of the discrete recess can be rounded to avoid a coarse feel. A taper in either direction can be applied to the discrete recess in order to increase or decrease the gripping surface area. In the case of fenestrations, a taper can also help to create an additional barrier to prevent the skin to come into contact with the threads. The skilled person will appreciate that the placement of the at least one discrete recess relative to the underlying thread can influence the retention force of the components, and understands how to suitably configure this accordingly. The skilled person can appreciate that the placement of the fenestrations on the thread support member, optionally at least partially within a subregion thereof, can expose the threaded parts, and understands how to suitably configure this to maintain integrity of the thread. The at least one discrete recess may be limited to the thread support member, but can also extend to a part of the thread, or can comprise the entire width of the thread. The at least one discrete recess may be open-ended or close-ended, by which is meant that the recess does not have to be bound by the respective thread support member wall or the wall of the subregion of the thread support member.

Figure 3:
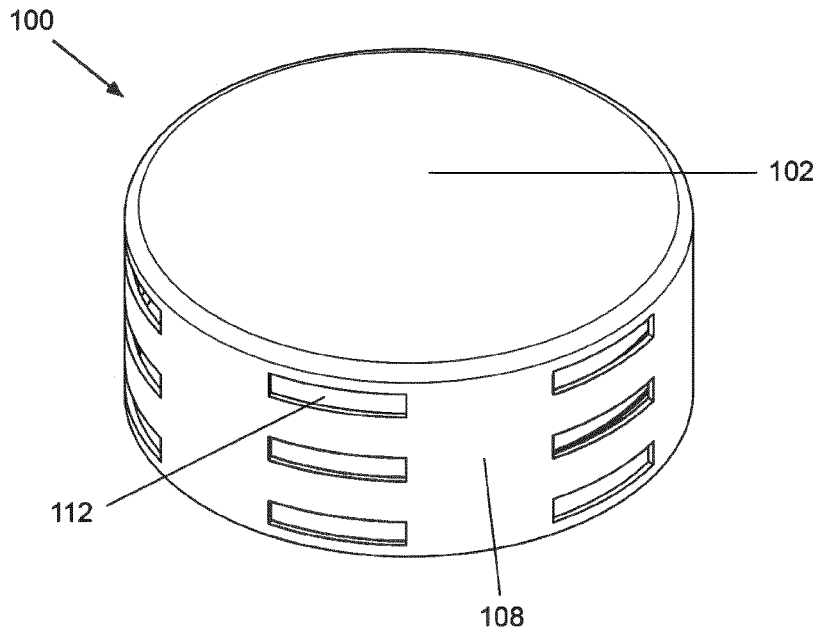
FIG. 3 is a schematic illustration of an exemplary threaded closure of the invention in which the thread support member has only discrete recesses that are rectangular fenestrations.
Figure 4:
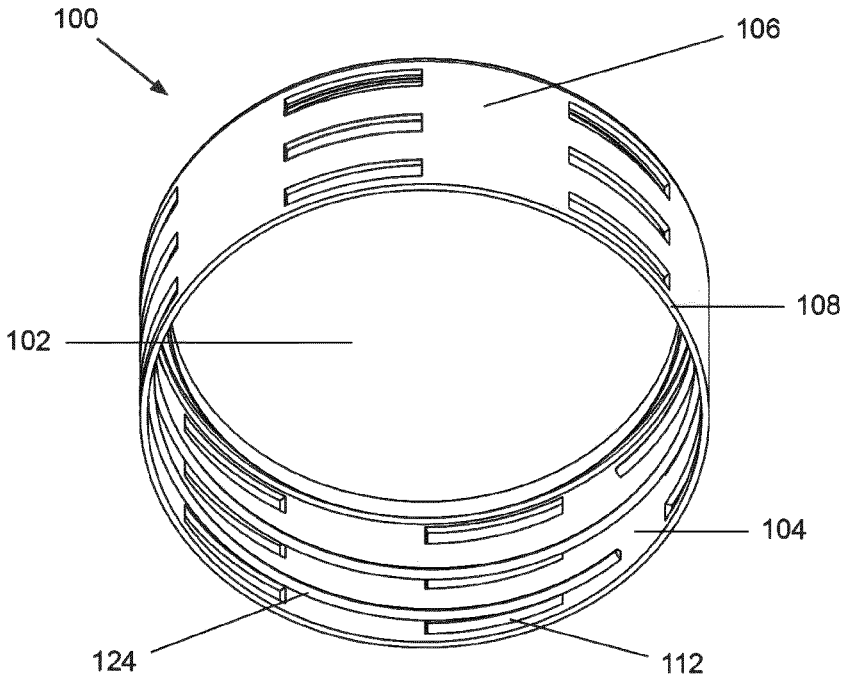
FIG. 4 is a different view of the exemplary threaded closure of FIG. 3.
Figure 5:
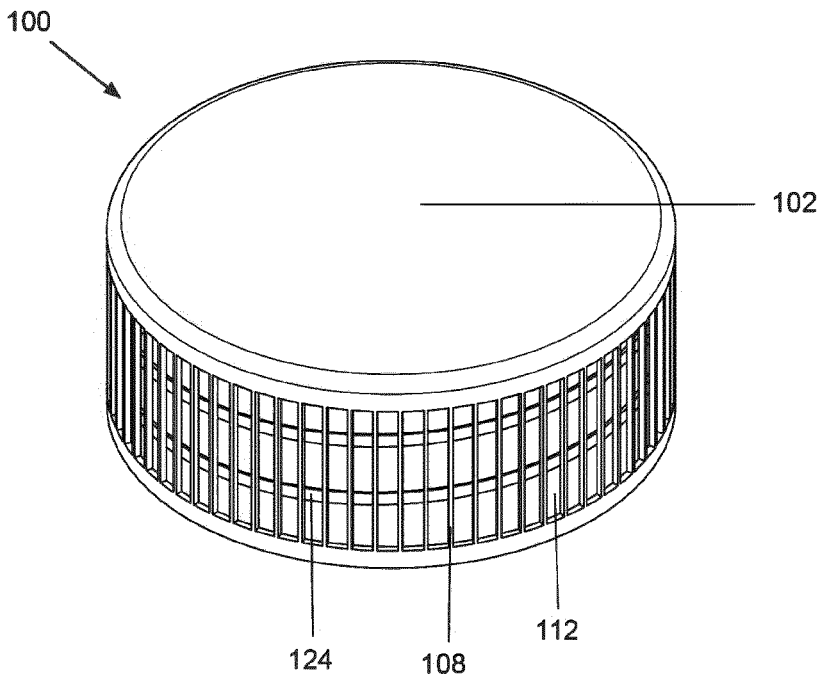
FIG. 5 is a schematic illustration of an exemplary threaded closure of the invention in which the thread support member has numerous discrete recesses that are rectangular fenestrations.

A discrete recess may take any form, e.g. slot like (see FIGS. 3-5). A discrete recess may take the form of a marking, preferably a three-dimensional marking (see FIGS. 11-14). The marking may be alphanumeric, graphical, pictorial, or any portrayal of visual communication. Such a marking can avoid the use of inks, and is indelible. Such a marking is machine readable. Such a marking has a high visual contrast, in particular for a discrete recess that is a fenestration.

There is preferably a plurality of discrete recesses. They may be evenly distributed around the periphery of the thread support member.

The thread support member is disposed with a thread. The thread is configured to engage with a complementary thread, for instance on a container, in particular on a container neck. The thread is configured to engage with a complementary thread by rotation of the closure. The thread of the threaded support member may extend to the top wall portion. The thread of the thread support member may extend to the open end of the thread support member. The thread may be confined to a subregion of the thread support member. The thread may be continuous or interrupted. The thread may be disposed on an inner surface or on an outer surface of the thread support member.

Because the thread support member is in connection with the top wall portion, and the thread is disposed on the thread support member, there is a transfer of displacement and/or force from the thread via the thread support member to the top wall portion.

When the thread in located on the inner surface of the thread support member, the outer surface of the thread support member may function as a surface to manipulate the closure, for instance to receive manual torque.

Where the container neck disposed with an opening is threaded on the outer surface, the threaded closure may be a threaded cap comprising a closed end top wall and a cylindrical thread support member extending therefrom disposed with a complementary inner threading (see for instance FIGS. 2-14). Where the container neck is threaded on the inner surface, the threaded closure may be a threaded plug comprising a closed end top wall and a cylindrical thread support member extending therefrom disposed with a complementary outer threading (see for instance FIGS. 15-16).

It is understood that a thread comprises a base in connection with a surface of the thread support member, a top portion that is typically, but not necessarily an apex, and one or more sidewalls connecting the base with the top portion which interact with the complementary container thread. This interaction causes displacement, force and friction. The skilled person will appreciate that the type of threading (e.g. diameter, pitch and number of revolutions, material) can influence the displacement and/or turn, amount of force required, level of stability, and understands how to suitably configure this accordingly.

The closure may be made from any suitable material. Preferably it is made at least partly, preferably substantially from a polymeric material. Preferably the polymeric material is mouldable. The closure may be made using a moulding process, for instance injection moulding.

The closure is intended to repeatably seal an opening. The term "repeatably" seal means that the closure is able to seal and subsequently unseal the opening more than once, preferably several times. By "seal" it is meant restrict flow across the opening and form a protective barrier. In such state, content can be stored in the container. Where the container is provided with a threaded neck on which an opening is disposed, the closure may be a threaded closure such as a threaded cap or plug configured to engage with the threaded neck and to seal the opening. By this action, the closure top wall portion is displaced relative to the neck and opening thereon, and can completely sealingly occlude the opening as rotation lifts or drops the closure top wall portion. The main components of the closure are a top wall portion, a thread support member, and a thread. There may be an unthreaded transitional portion that connects the top wall portion to the threaded subregion of the thread support member. The top wall portion acts as an occluding surface and protective barrier (directly or indirectly) when it is pressed on a container opening. The closure thread interacts with the container thread, and can displace, and apply force and tension to the top wall portion through the thread support member. The closure thread material, container thread material, thread shape and thread length determine the retention force of a closure on a container. The thread support member transfers forces from the thread to the top wall. When the thread in located on an internal surface, the thread support member has an external surface to manipulate the closure. In contrary to the top wall portion, the thread support member does not function as a protective barrier for the container content. Because the thread support member does not act as a protective barrier, the discrete recesses do not diminish its functions. The discrete recesses add function, and offer gripping surfaces through which the closure can be easily manipulated. Because no additional gripping protrusions are necessary, the closure is lightweight. Beside aforementioned mass reduction that is the result of omitting the gripping protrusions, the discrete recesses decrease the weight of the closure by reducing the volume of the thread support member. Because there is no need for additional gripping protrusions, the thread support member has a smooth and pleasant surface. This is due to the fact that there are no protrusions that cause an increased pressure which activates the pressure sensors in the fingers. Because the thread support member is lighter there is less force required for turning the closure, and it can be turned at a higher speed. These improvements of the turning characteristics make the overall manipulation of the closure easier and more pleasant. In the case of fenestrations on the thread support member, gas from within the container can escape easily and smoothly through the fenestrations of the thread support member. This can be particularly interesting for pressurized containers. By varying the amount of turning the gas flow can be controlled gradually and accurately. Compared to the currently available fenestrations for venting in the unthreaded transitional portion from the top wall to the subregion of the thread support member disposed with the thread fenestrations in the threaded portion of the sidewall (subregion of the thread support member) allow a more efficient and unobstructed venting. There is a more efficient venting because larger fenestrations can be made in the subregion of the thread support member because it has a much larger surface area compared to the unthreaded transitional portion from the top wall to the subregion of the thread support member. The venting through the fenestrations in the subregion of the thread support member is unobstructed compared to the venting through fenestrations in the unthreaded transitional portion from the top wall to the subregion of the thread support member. This is because sealing rims are also located at the height of the unthreaded transitional portion from the top wall to the subregion of the thread support member and at least partially obstruct fenestrations in the unthreaded transitional portion from the top wall to the subregion of the thread support member.

The at least one discrete recess may be disposed at least partially optionally fully within a subregion of the thread support member spanning the length of the thread. The at least one discrete recess may be disposed at least partially in the subregion of the thread support member, meaning the at least one discrete recess may extend upward or downward from the subregion into a region that may not be threaded. The position of the at least one discrete recess does not confine any of the characteristics of the thread. The thread may have any number of turns (1/12, 1/8, 1/4, 1/2, 3/4, 1, 1 1/2, 3, etc.) and any length. The thread may have any shape or form. The thread may be continuous or interrupted. Where the thread is continuous it may advantageously contribute to the mechanical strength of the thread support member. Where the thread is interrupted there may be bridges between the discrete recesses that are configured to contribute to the mechanical strength of the thread support member. The bridges may be disposed on the inner surface of the thread support member, they may be part of the thread support member, or they may be disposed on the outer surface of the thread support member. The shape or form of the thread may be the same or different from the shape of the thread support member. There may be one or more threads. In case of multiple threads they may have the same characteristics or be different (e.g. different thread length). In case of multiple threads they may be overlapping.

The fenestrations may be used as openings through which content is poured, this has multiple advantages. One advantage of pouring content through the fenestrations is that entirely unscrewing and taking off the cap is not necessary. Because the closure does not have to be removed entirely it cannot be misplaced, fall or become contaminated. This saves time and effort, and makes pouring easier. Another advantage is that the flow speed can be controlled accurately by the extent of unscrewing of the closure, and one does not have to rely anymore on the tilting angle to determine the flow speed. The aforementioned is applicable both for threaded closures wherein the thread is disposed on the inner surface of the thread support member as well as for threaded closures wherein the thread is disposed on the outer surface of the thread support member. Because the tilting back and forth is not necessary the container can be held or positioned at a fixed angle or fully inverted, which makes the assessment of the poured volume easier and more accurate. The flow speed can be controlled not only by turning the closure which gradually exposes more of the fenestration, but also by the size of the fenestration or fenestrations on the thread support member. This is particularly interesting for instances where the maximum flow speed needs to be reduced in order to allow a better dosing of the content (e.g. edible oils), and it eliminates the need for a separate flow speed modifier. Compared to the usually non-dismountably attached flow speed modifiers a closure with fenestrations can offer the user a wide array of pouring possibilities. For example the closure can be provided with fenestrations of different sizes beside each other, thus allowing the user to choose the appropriate fenestration size. Not only can the flow speed be controlled accurately, but a specific flow pattern (e.g. disperse flow, sprinkle, etc.) can be achieved by the fenestrations. Characteristics that determine the flow pattern include but are not limited to the shape, size, number and position of the fenestrations. For example to achieve a disperse flow (e.g. to water grass or plants, sprinkle salt, convert a container into a portable shower, etc.) fenestrations can be placed circular on the thread support member of a closure (see for example FIG. 18). A triangular fenestration can be used to achieve an exponential increase of flow speed with turning (see for example FIG. 17). In case the shape of the fenestration is rectangular there is a linear increase of flow speed (see for example FIGS. 19-20).

Among others the size, shape and number of fenestrations can be adjusted in such a way as to accommodate efficient pouring. For example the lower edge of a fenestration may have a lip (see for example FIGS. 19-20), or be V or U-shaped. Additional elements such as but not limited to a spout, nozzle, pipe, tube, hose etc. may be provided on the fenestrations to further accommodate efficient pouring (see for example FIGS. 21-22). These elements may be merged with the fenestrations, or they may be separate or attached dismountably or non-dismountably to the fenestrations. There are no restrictions for the position and angle of aforementioned pouring aids. The pouring aid can be placed perpendicular to the axis of rotation of the closure (see for example FIGS. 21-22), but it may also be placed at an angle that is inclined either toward the closed end of the closure or toward the open end of the closure.

Fenestrations that are placed in different parts of the thread support member can have different functions. For example when a conventional container is tilted 90 degrees from its resting position the fenestrations that are facing downward are used to pour content out of while the fenestrations that are facing upward are used for venting. The fenestrations thus allow a synchronized, repeatable, adjustable, and gradual control of flow. The matter that can flow through the fenestrations can be any flowable matter. The flowable matter may be, for instance, fluid, liquid, gel, gas, powder. It may be air. Examples of flowable matter include beverages (e.g. still, carbonated), catering products (e.g. oils, dressings, sauces), sprinkle-able products (e.g. sugars, flavourings, spices) and the like. The flowable matter that passes through the fenestrations that are facing downward is preferably a liquid, the flowable matter that passes through the fenestrations that are facing upward is preferably a gas. The skilled person will appreciate that the respective sizes and shapes of the fenestrations can be altered so as to change the rate of air inflow and content outflow. The skilled person will appreciate that among others the position of the fenestrations relative to the top wall and relative to each other influence the pouring characteristics (e.g. pouring without glugging), and he can understand how to suitably configure this accordingly. For example the position of the fenestrations can be chosen in such a way that when turning the closure venting is initiated first, and only hereafter pouring is possible. Preferably the fenestration for pouring and the fenestration for venting are placed diametrically opposed on the thread support member. The closure may be provided with additional elements that further facilitate pouring without glugging. These include but are not limited to venting tubes, air flow channels, partitioning bodies etc.. Aforementioned elements may be linked dismountably or non-dismountably to the fenestrations. Depending among others on the number of fenestrations on the thread support member there may be more than one fenestration that accommodates venting. Depending among others on the number of fenestrations on the thread support member there may be more than one fenestration that accommodates pouring.

Another advantage is that the fenestrations can act as an integrated particle filter, thereby eliminating the need for a separate filter which takes space and can get lost. This can be interesting for among others foods or liquids. For example a closure with fenestrations can be used in case fruits, fruit peels, herbs, ice or other foodstuff are immersed in a liquid in a container, and one only wants to consume the liquid. Another example is orange juice with pulp. Threaded closures with fenestrations can offer the consumer the choice to drink the juice with or without pulp. A closure with fenestrations on its thread support member can also be used to drain the liquid from a container without letting the solid content out (e.g. pickled cucumbers). The integrated filter can also be of value for survival purposes when one needs to filter debris from water.

When content is poured through the fenestrations they can aerate a liquid and thus improve its characteristics. This can be interesting for example for wine. Because the closure with fenestrations can function as an aerator there is no need for a separate aerator which takes up space and can get lost.

The interior surface of the thread support member can be provided with a substance to enhance the property of the content. For instance silver to kill bacteria, a flavour enhancer, gas-releasing substances (sparkle-enhancers), a catalyst, etc.. These substances are activated only during pouring through the fenestrations. The surface is not brought into contact with the liquid until pouring, and the cap allows the substance to remain in dry storage (stable condition) until use.

The fenestrations in the thread support member of closures also allow visualization of the mechanism of the threads, which has multiple advantages. Not only does this make a very attractive design for consumers, but it also allows the user to directly see to which extent the closure is open or closed without the need to manually check this. For manufacturers of closures the direct visibility allows to study threads more closely to further optimize thread design. Embodiments of closures of the invention can allow portrayal of visual communication through different ways. The discrete recesses on the thread support member can be shaped in such a way that they portray visual communication of messages, or the smooth surface of the thread support member can be used for portrayal of visual communication (e.g. printing). The visual communication may be graphical, text, numerical, or a combination of these.

The at least one discrete recess allows communication of information in a three dimensional manner, which has multiple advantages compared to the currently used methods of communication (e.g. two dimensional printing). Visual communication of information in a three dimensional way not only communicates the information in a more vibrant manner, but it also makes reading it easier. This is particularly true when the information is required to be read by machines. Three dimensional information can be read faster and with greater accuracy. Not only can the three dimensional information be read better visually, but it can also be read by touch. This is particularly interesting for the visually impaired, but it can also be useful when visual perception is not possible (e.g. in the dark, when the item is located at the bottom of a bag, etc.). Communicating information through discrete recesses on the closure and not through markings on the recipient has multiple advantages. Because the closure is much smaller than the recipient and it fits in the hand one does not have to search the large surface of the recipient for the information. Another advantages is that once the information has been perceived, because the hand is already on the closure, it can be opened immediately hereafter and moving the hand is not necessary.

Because the information is portrayed in a three dimensional manner, the closure can also function as a rolling stamp. This is attractive for consumers, particularly for children.

The at least one discrete recess in the thread support member of a closure, preferably formed as a fenestration, significantly reduces the material volume and substantially increases the surface area and thus may be configured to improve the heat dissipation capacity of the closure, preferably during and after manufacture. The discrete recesses make the dissipation of heat considerably faster and more efficient. This reduces the duration of the cooling phase during production which results in a faster cycle time and increased production speed. The improved heat dissipation also allows a faster cooling during the second cooling phase after ejection which decreases the risk of deformation during stacking.

Discrete recesses in the thread support member of threaded closures increase the flexibility of the thread support member and the entire closure. Closures with increased flexibility accommodate a tighter fit, and the critical margin to fit on the receiving neck is larger. Because of this less closures need to be discarded because they do not fit the strict dimensions. This not only leads to an increase in production volume, but it also reduces the amount of waste. A more flexible thread support member not only reduces the risk for a closure to become lodged on the receiving neck when it is put on with significant torque (e.g. capping at a factory site), but it can also be released easier in case it becomes lodged because less force is required to overcome the retaining forces between the closure and the receiving neck.

Beside the reduced transport cost because of the weight advantage of closures with discrete recesses there is less energy required for the processing and recycling of this type of closure. This is because less energy is required for the shredding of closures with discrete recesses because the thread support member can be disintegrated more easily.

The closure may be a part of a system or have additional elements. In this sense the closure and thus the at least one discrete recess may cover, be covered by, or be linked to additional elements or components.

The outer surface of the at least one discrete recess may be obstructed fully or partially by other elements of the closure or other components, or it may be exposed fully to the atmosphere (e.g. for visualization). The inner surface of the at least one discrete recess may be obstructed fully or partially by other elements of the closure or other components, or it may be exposed fully to the atmosphere.

One or more stop or indication elements may be provided on the closure and/or receiving neck. These elements can indicate a certain degree of turning, restrict further turning, prevent removal of the closure etc..

It is appreciated that the discrete recess or fenestration referred to herein may be disposed at least partially optionally fully within the subregion of the thread support member. Where there is a plurality of discrete recess or fenestrations at least one of them optionally all of them may be disposed at least partially optionally fully within the subregion of the thread support member.

All aforementioned aspects including but not limited to the characteristics and effects of the at least one discrete recess and/or fenestration of a threaded closure may be applied to a receiving neck for a threaded closure. The receiving neck is disposed with a complementary thread and typically provided on a container such as a bottle. Such receiving neck that is provided with at least one discrete recess (see for example FIGS. 23-24) may further be provided with additional elements such as but not limited to sealing elements such as sealing grooves on an additional projecting shoulder.

Figure 2:
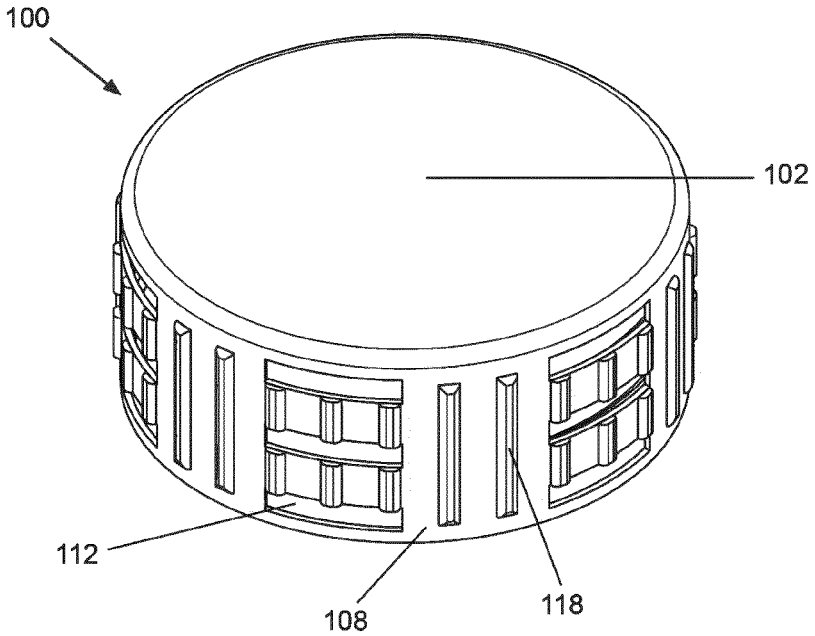
FIG. 2 is a schematic illustration of an exemplary threaded closure of the invention in which the thread support member has both longitudinally placed rectangular gripping protrusions as well as a plurality of discrete recesses that are rectangular fenestrations.

FIG. 1 depicts a threaded closure as is currently available in the art. The closure comprises a top wall portion (102) and a thread support member (108) having a uniform wall thickness and a thread. The outer wall of thread support member (108) is provided with longitudinally placed rectangular gripping protrusions (118) which increase friction. In FIG. 2 the thread support member (108) of the exemplary threaded closure (100) of the invention has longitudinally placed rectangular gripping protrusions (118), and a plurality of discrete recesses (112) that are rectangular fenestrations. These discrete recesses (112) that are fenestrations make the closure more lightweight, give a gripping surface, and allow a more direct outflow of gas.

In FIG. 3 the thread support member (108) of the exemplary threaded closure (100) of the invention has discrete recesses (112) that are rectangular fenestrations orientated in a circumferential direction.

FIG. 4 is a different view of the exemplary threaded closure of FIG. 3. The closure thread support member (108) allows transfer of displacement and force from the internal thread (124) to the top wall portion (102). The outer surface (106) of the thread support member (108) is otherwise smooth, which makes it possible to portray visual communication (e.g. printing). In this example the discrete recesses (112) that are fenestrations are mainly disposed between the threads (124).

In FIG. 5 the thread support member (108) of the exemplary threaded closure (100) of the invention has numerous discrete recesses (112) that are rectangular fenestrations orientated in a longitudinal direction. Because these discrete recesses (112) that are fenestration are numerous, the total volume of material forming the thread support member (108) is small, thus making this closure lightweight. Because of the high number of fenestrations, the thread (124) and working mechanism are visible. This makes an attractive design, and improves recognition of the product on the shelf.

Figure 6:
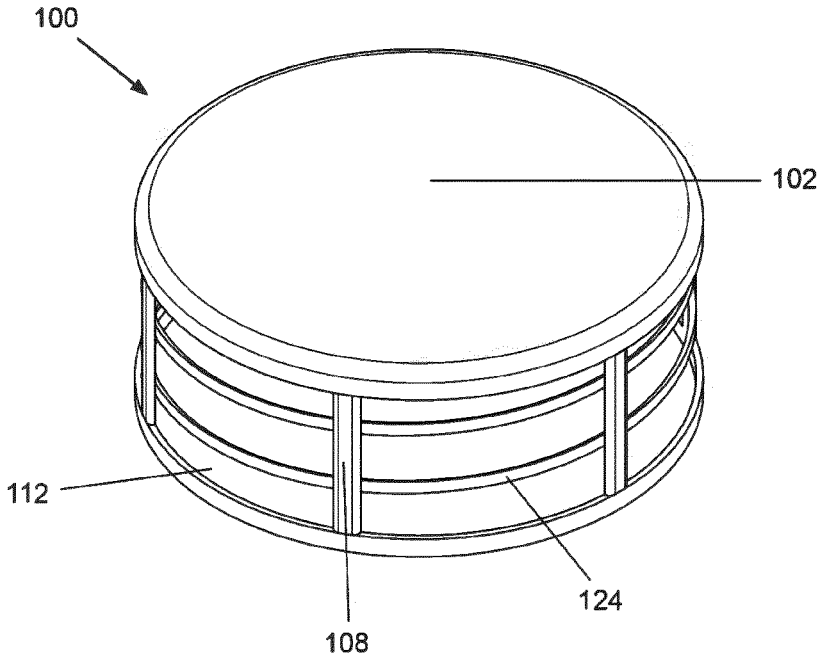
FIG. 6 is a schematic illustration of an exemplary threaded closure of the invention in which the thread support member has 6 large discrete recesses that are rectangular fenestrations.

In FIG. 6 the thread support member (108) of the exemplary threaded closure (100) of the invention has 6 large discrete recesses (112) that are rectangular fenestrations. The large void volume of these discrete recesses (112) that are fenestrations make this closure very lightweight. The thread support member (108) is reduced to six pillars which link the thread (124) to the top wall portion (102). Because of the large void volume of the rectangular fenestrations, the thread (124) and working mechanism are visible. This makes an attractive design, and improves recognition of the product on the shelf.

Figure 7:
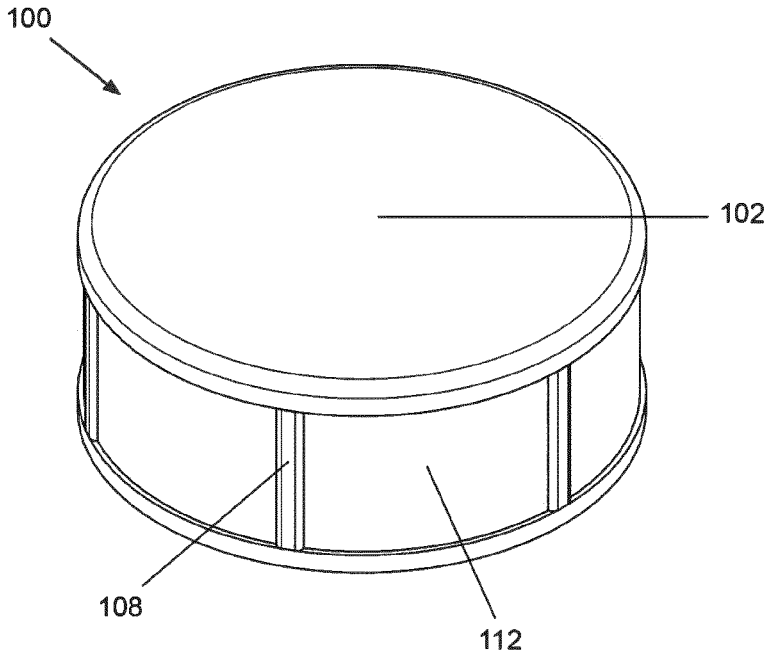
FIG. 7 is a schematic illustration of an exemplary threaded closure of the invention in which the thread support member has 6 large discrete recesses.

In FIG. 7 the thread support member (108) of the exemplary threaded closure (100) of the invention has 6 large discrete recesses (112), they do not pass through the wall of the thread support member (108). Because these discrete recesses (112) have such a large void volume, there is a smooth feel when manipulating the closure.

Figure 8:
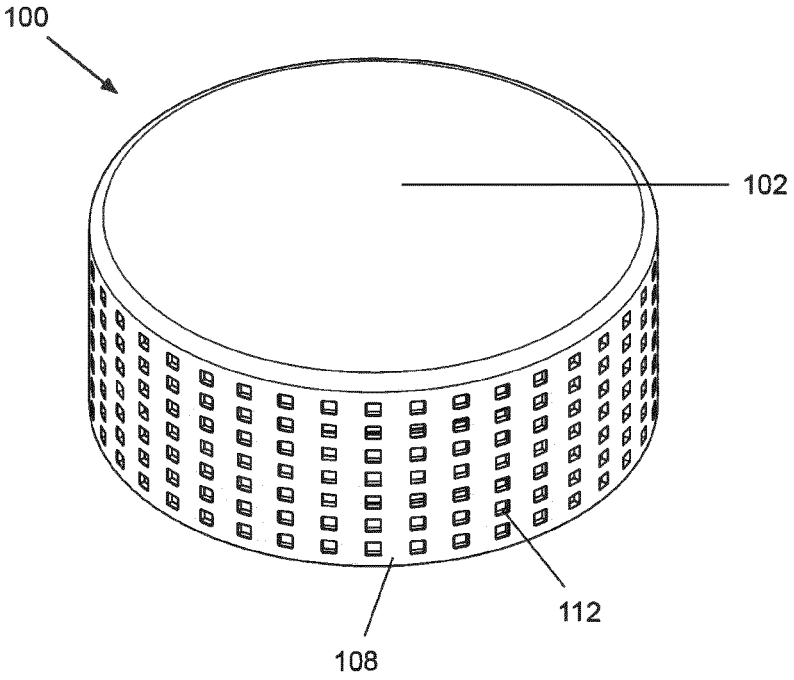
FIG. 8 is a schematic illustration of an exemplary threaded closure of the invention in which the thread support member has numerous discrete recesses that are square fenestrations.

In FIG. 8 the thread support member (108) of the exemplary threaded closure (100) of the invention has numerous discrete recesses (112) that are square fenestrations. The surface of the thread support member (108) is mostly smooth, which makes it possible to portray visual communication (e.g. printing). The square shape of the fenestrations create both a longitudinal and perpendicular gripping surface.

Figure 9:
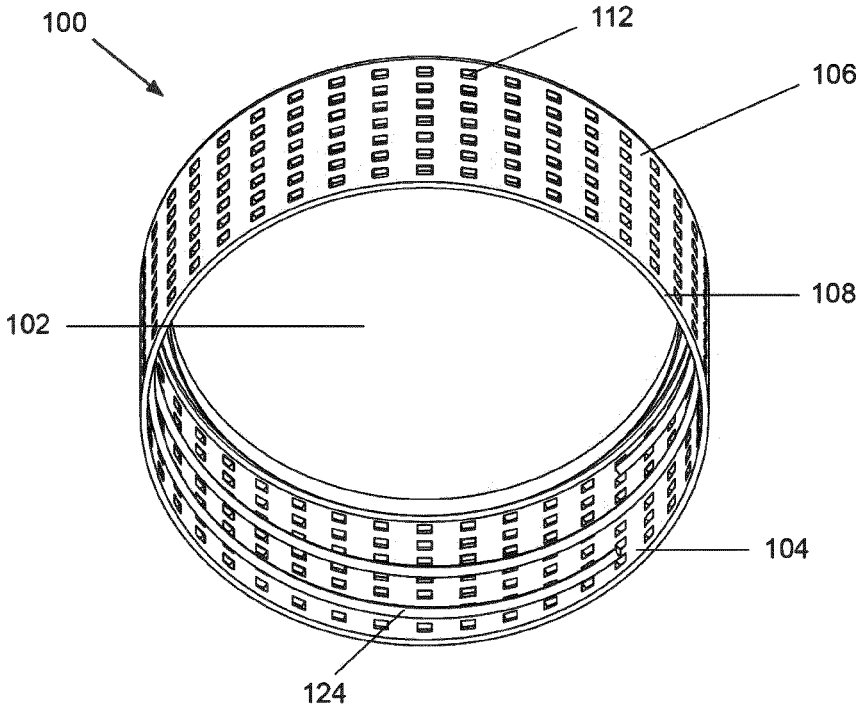
FIG. 9 is a different view of the exemplary threaded closure of FIG. 8.

FIG. 9 is a different view of the exemplary threaded closure of FIG. 8. In this example the discrete recesses (112) that are fenestrations extend up to the thread (124); they only comprise the thread support member (108).

Figure 10:
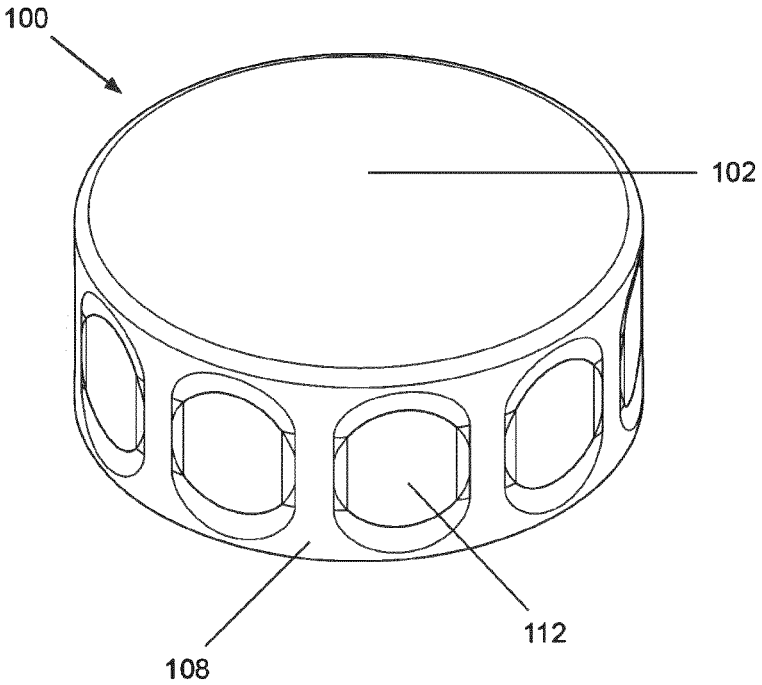
FIG. 10 is a schematic illustration of an exemplary threaded closure of the invention in which the thread support member has numerous oval discrete recesses.

In FIG. 10 the thread support member (108) of the exemplary threaded closure (100) of the invention has numerous oval discrete recesses (112). These oval shaped discrete recesses (112) allow easy manipulation while retaining the smooth feel because they co-operate fittingly with the pads or tips of the fingers.

Figure 11:
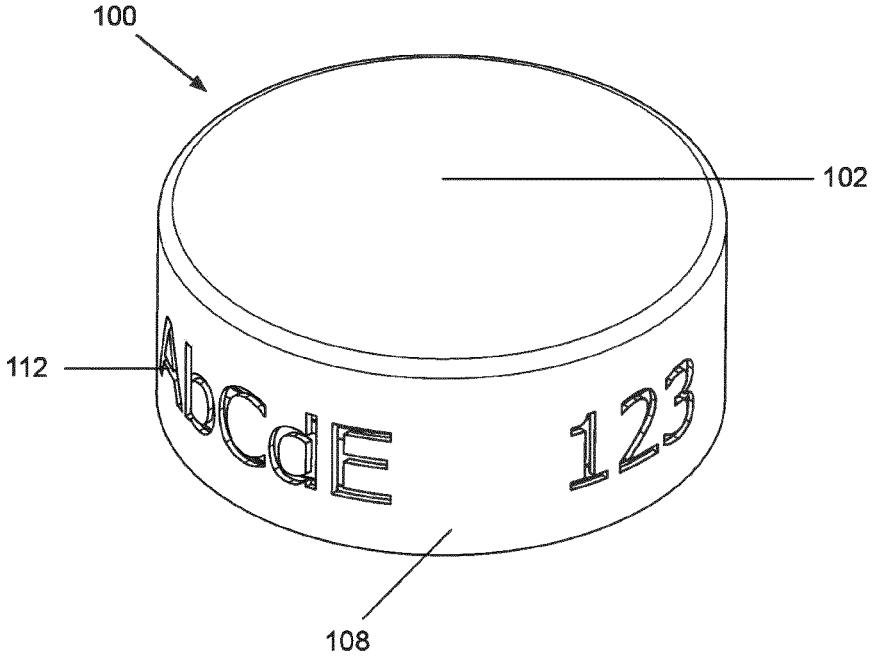
FIG. 11 is a schematic illustration of an exemplary threaded closure of the invention in which the thread support member has a plurality of discrete recesses that are fenestrations taking the form of alphanumeric markings.

In FIG. 11 the thread support member (108) of the exemplary threaded closure (100) of the invention has a plurality of discrete recesses (112) that are fenestrations taking the form of alphanumeric markings. These discrete recesses (112) that are fenestrations offer a gripping surface, make the closure lightweight, allow a smooth outflow of gas, and portray indelible, high contrast, machine readable visual communication. Despite the presence of these fenestration the thread support member (108) is mostly smooth, which gives a pleasant feeling when manipulating this closure.

Figure 12:
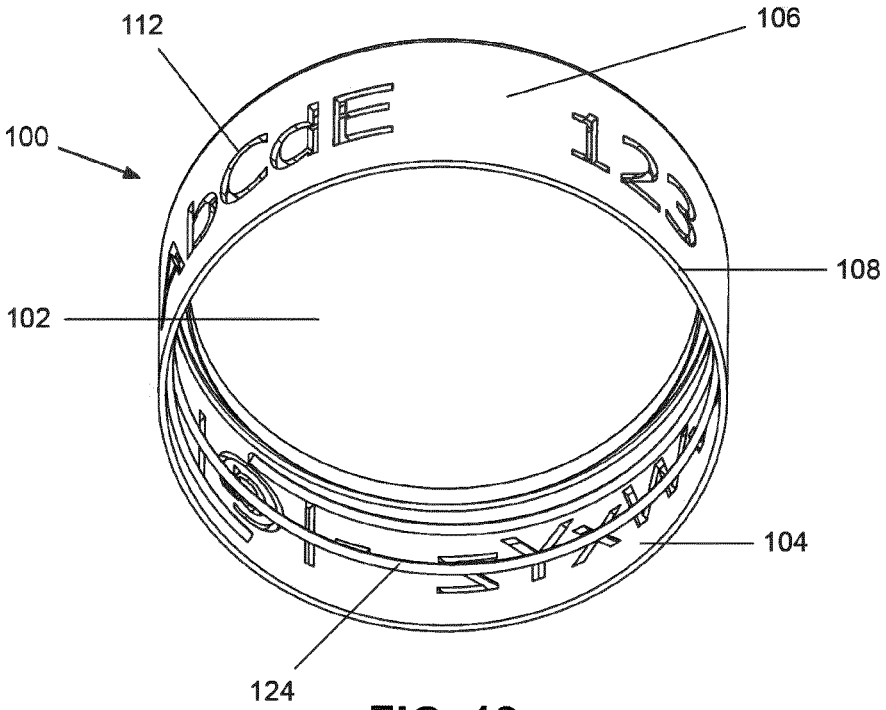
FIG. 12 is a different view of the exemplary threaded closure of FIG. 11.

FIG. 12 is a different view of the exemplary threaded closure of FIG. 11. In this example the discrete recesses (112) that are fenestrations extend up to the thread (124); they only comprise the thread support member (108).

Figure 13:
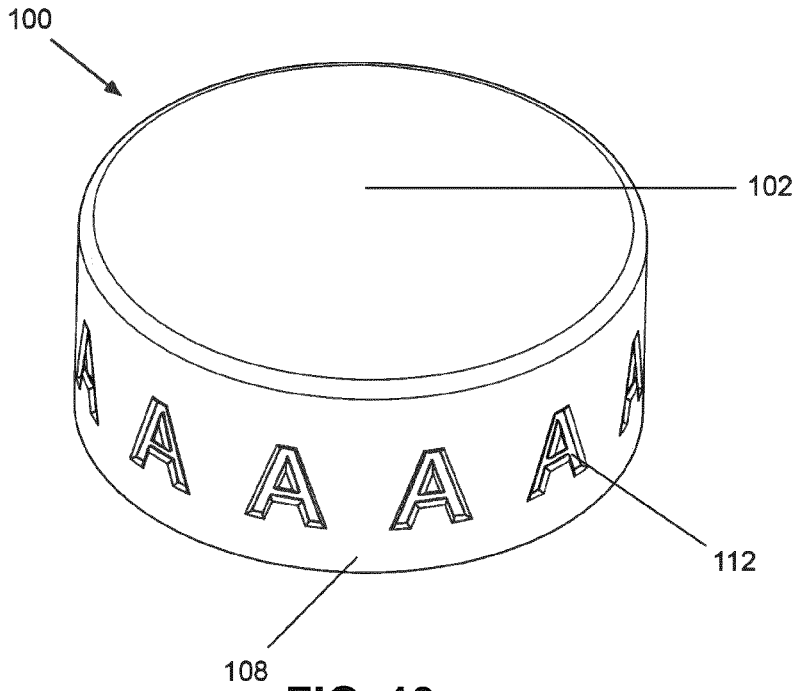
FIG. 13 is a schematic illustration of an exemplary threaded closure of the invention in which the thread support member has letter shaped discrete recesses.

In FIG. 13 the thread support member (108) of the exemplary threaded closure (100) of the invention has letter shaped discrete recesses (112). These discrete recesses (112) offer smooth gripping elements, make the cap more lightweight, and portray indelible, high contrast, machine readable visual communication.

Figure 14:
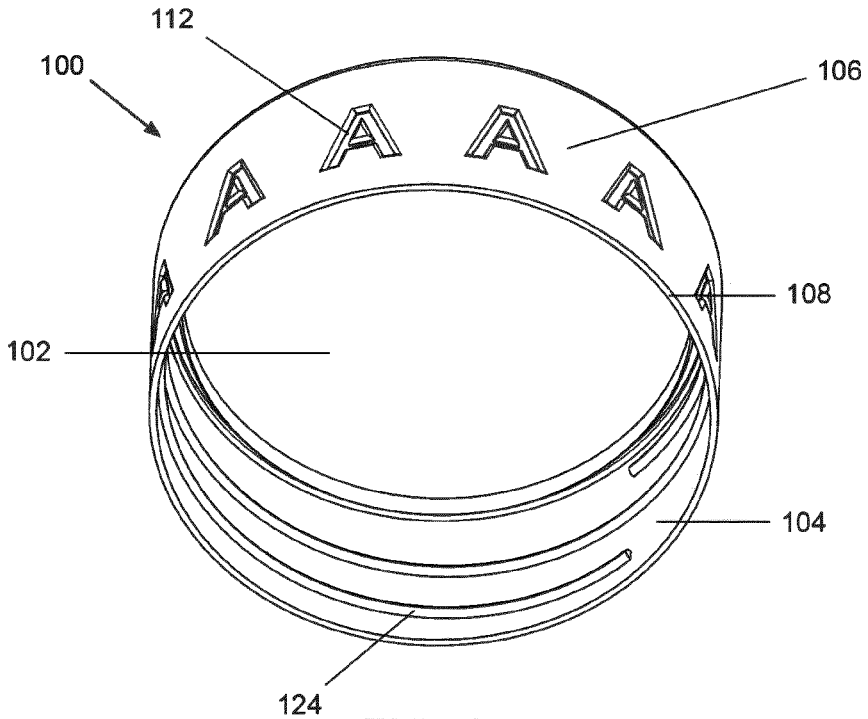
FIG. 14 is a different view of the exemplary threaded closure of FIG. 13.

FIG. 14 is a different view of the exemplary threaded closure of FIG. 13. The thread (124) which is disposed on the inner surface (104) of the thread support member (108) is not unduly influenced by the letter shaped discrete recesses (112).

Figure 15:
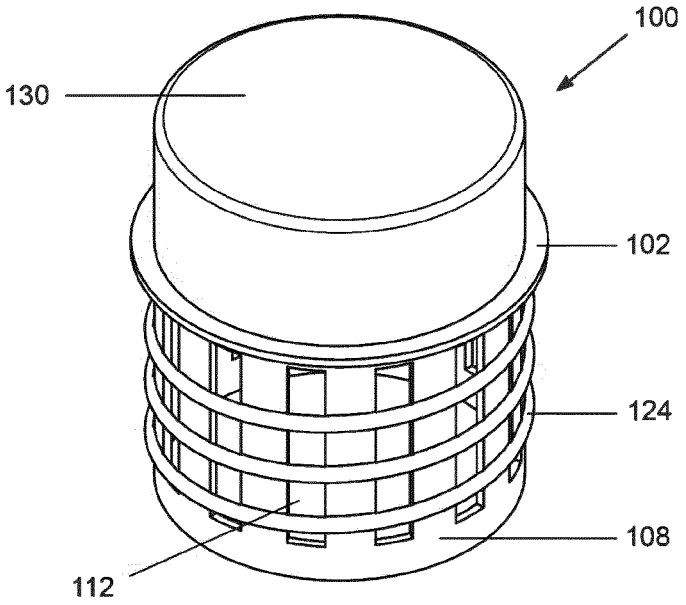
FIG. 15 is a schematic illustration of an exemplary threaded closure of the invention in which the thread support member has numerous longitudinally placed discrete recesses which are rectangular fenestrations.

In FIG. 15 the thread support member (108) of the exemplary threaded closure (100) of the invention has numerous discrete recesses (112) which are longitudinally placed rectangular fenestrations. The longitudinally extending handle (130) allows easy manipulation of the closure. The thread (124) is disposed on an outer surface (106) of the thread support member (108).

Figure 16:
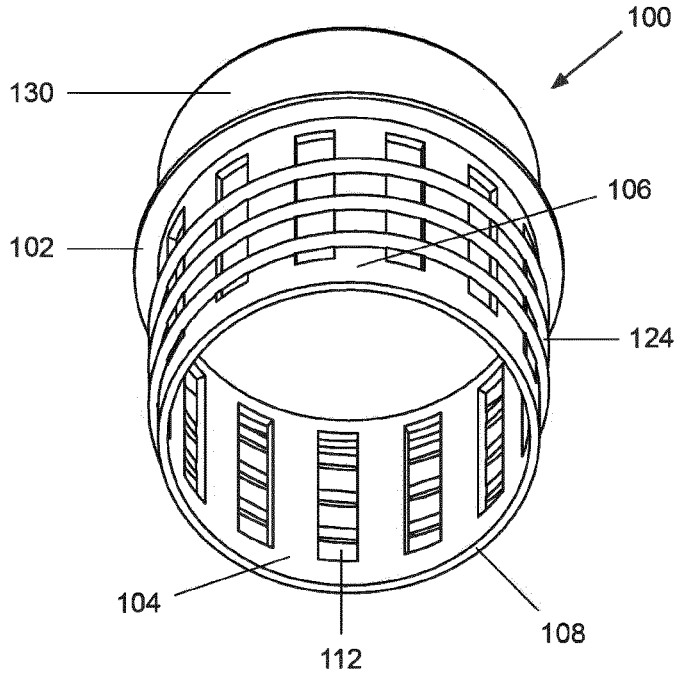
FIG. 16 is a different view of the exemplary threaded closure of FIG. 15.

FIG. 16 is a different view of the exemplary threaded closure of FIG. 15. The thread (124) which is disposed on the outer surface (106) of the thread support member (108) is not unduly influenced by the discrete recesses (112) which are longitudinally placed rectangular fenestrations.

Figure 17:
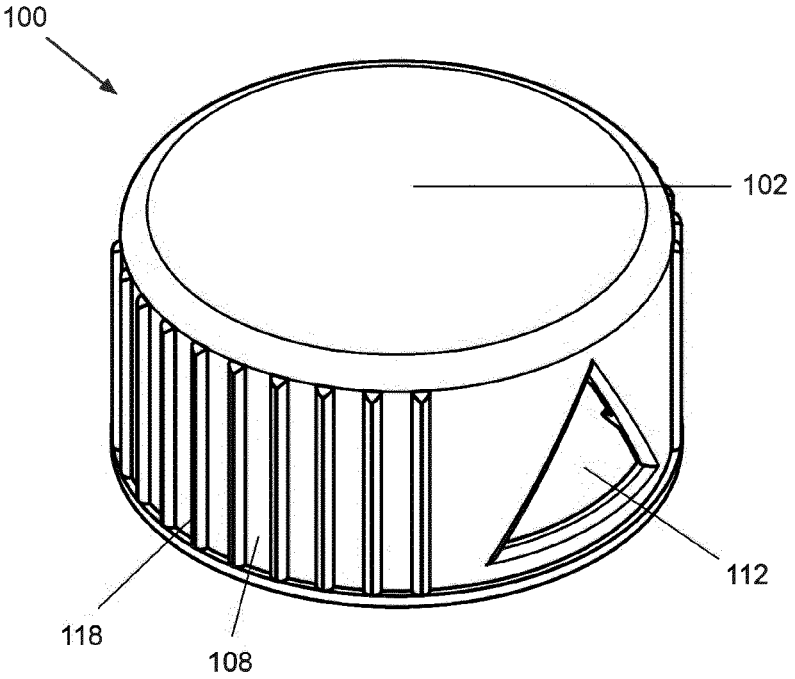
FIG. 17 is a schematic illustration of an exemplary threaded closure of the invention in which the thread support member has two discrete recesses that are triangular fenestrations.

In FIG. 17 the thread support member (108) of the exemplary threaded closure (100) of the invention has two discrete recesses (112) that are fenestrations taking the form of triangles. These discrete recesses (112) that are fenestrations may be used as openings through which content is poured. The triangular shape of the fenestration (112) is configured for an exponential increase of flow speed when opening the closure (100). When inverted to pour, the V-shaped part of the fenestrations (112) accommodates efficient pouring.

Figure 18:
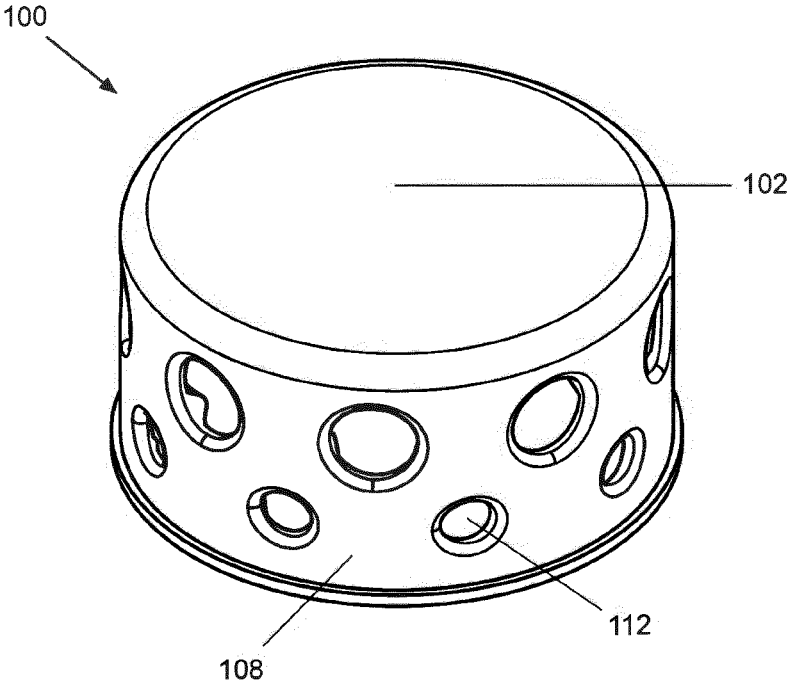
FIG. 18 is a schematic illustration of an exemplary threaded closure of the invention in which the thread support member has numerous discrete recesses that are circular fenestrations of two different sizes.

In FIG. 18 the thread support member (108) of the exemplary threaded closure (100) of the invention has numerous discrete recesses (112) that are fenestrations taking the form of circles. There are two different sizes of circles. These discrete recesses (112) that are fenestrations may be used as openings through which content is poured. The position, shape and differing sizes of the fenestrations (112) are configured to provide a disperse flow (e.g. to water grass or plants, sprinkle salt, convert a container into a portable shower, etc.).

Figure 19:
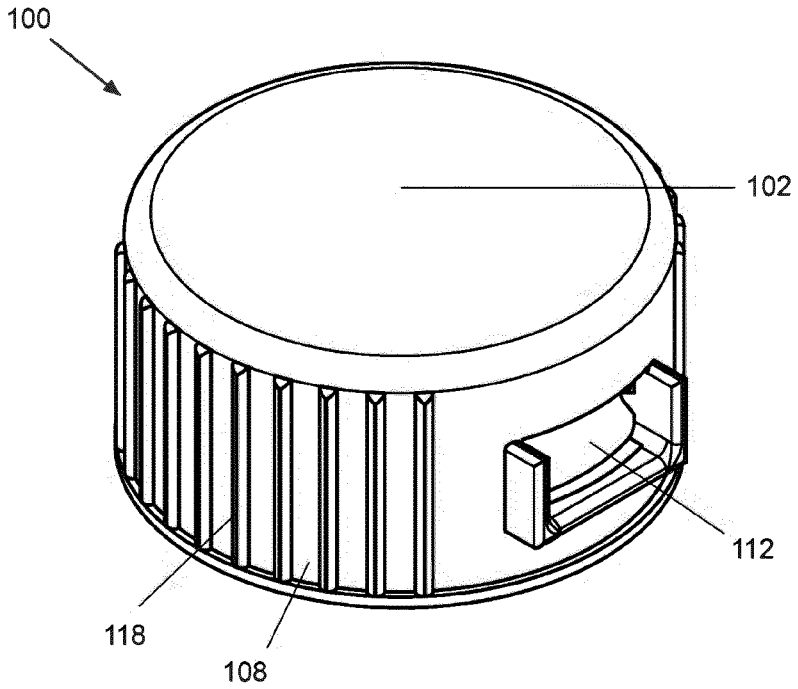
FIG. 19 is a schematic illustration of an exemplary threaded closure of the invention in which the thread support member has two discrete recesses that are rectangular (oblong) fenestrations wherein one fenestration is provided with a lip.

In FIG. 19 the thread support member (108) of the exemplary threaded closure (100) of the invention has two discrete recesses (112) that are fenestrations taking the form of rectangles (oblongs). These discrete recesses (112) that are fenestrations may be used as openings through which content is poured. One of the rectangular fenestrations (112) is provided with a lip that is configured to accommodate efficient pouring.

Figure 20:
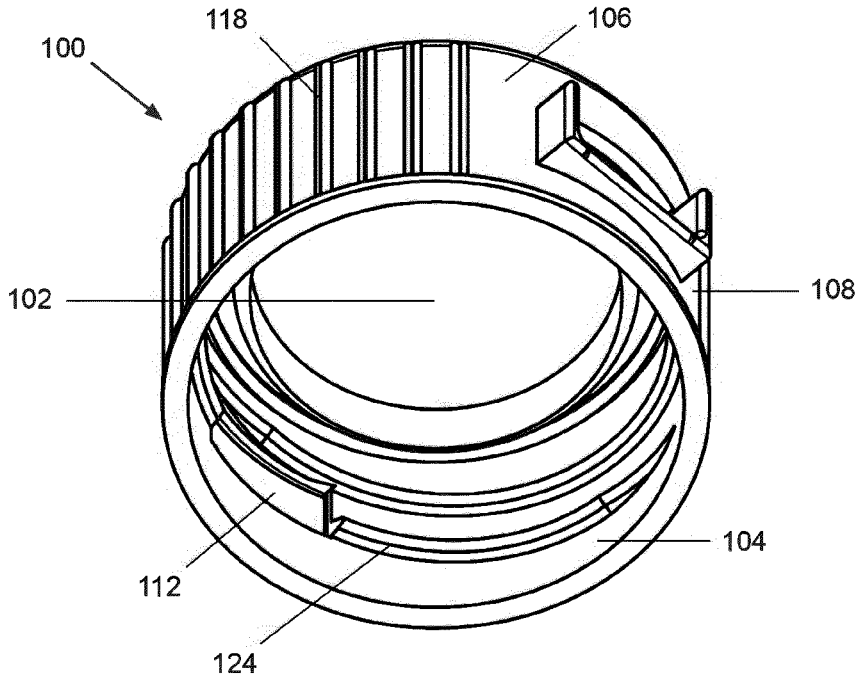
FIG. 20 is a different view of the exemplary threaded closure of FIG. 19.

FIG. 20 is a different view of the exemplary threaded closure of FIG. 19. In this example the discrete recess (112) that is a fenestration with a lip is preferably used as the opening through which content is poured while the discrete recess (112) that is a fenestration without a lip is preferably used as the opening for simultaneous venting.

Figure 21:
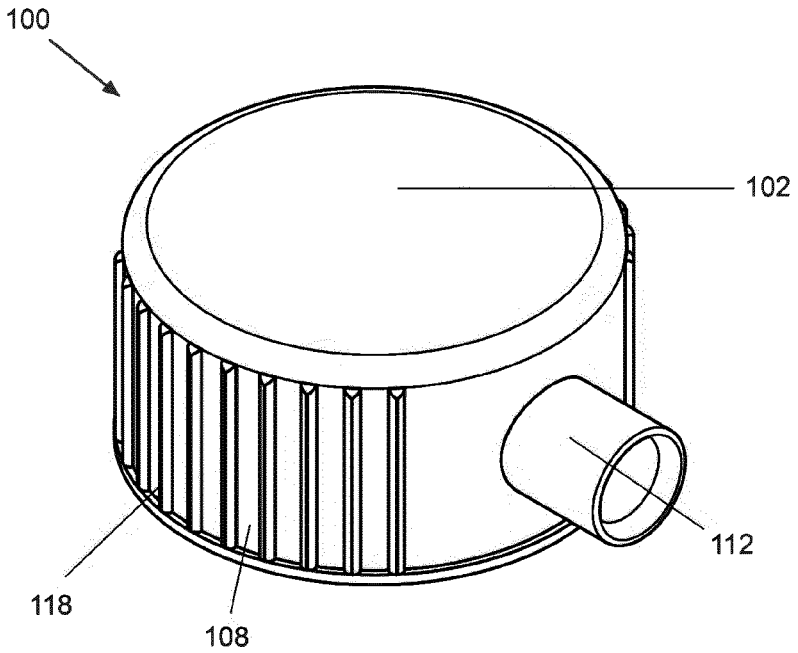
FIG. 21 is a schematic illustration of an exemplary threaded closure of the invention in which the thread support member has two discrete recesses that are circular fenestrations wherein one fenestration is provided with a spout.

In FIG. 21 the thread support member (108) of the exemplary threaded closure (100) of the invention has two discrete recesses (112) that are fenestrations taking the form of circles. These discrete recesses (112) that are fenestrations may be used as openings through which content is poured. One of the circular fenestrations (112) is provided with a spout that is configured to accommodate efficient pouring.

Figure 22:
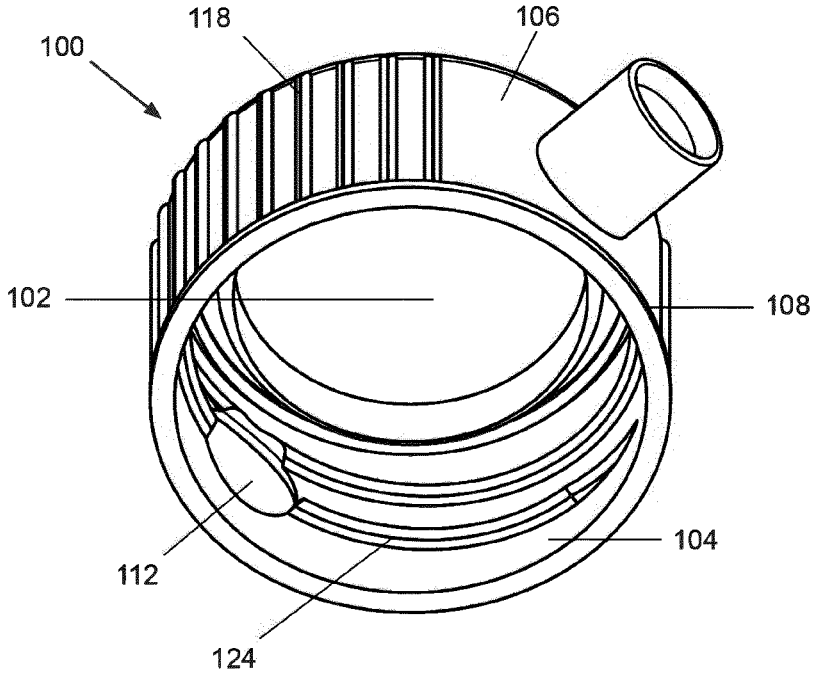
FIG. 22 is a different view of the exemplary threaded closure of FIG. 21.

FIG. 22 is a different view of the exemplary threaded closure of FIG. 21. In this example the discrete recess (112) that is a fenestration with a spout is preferably used as the opening through which content is poured while the discrete recess (112) that is a fenestration without a spout is preferably used as the opening for simultaneous venting. In FIG.

23 the neck thread support member (208) of the exemplary threaded neck (200) has numerous discrete recesses (212) that are rectangular fenestrations orientated in a longitudinal direction. The neck is provided with sealing grooves (240) on the additional projecting shoulder.

Figure 23:
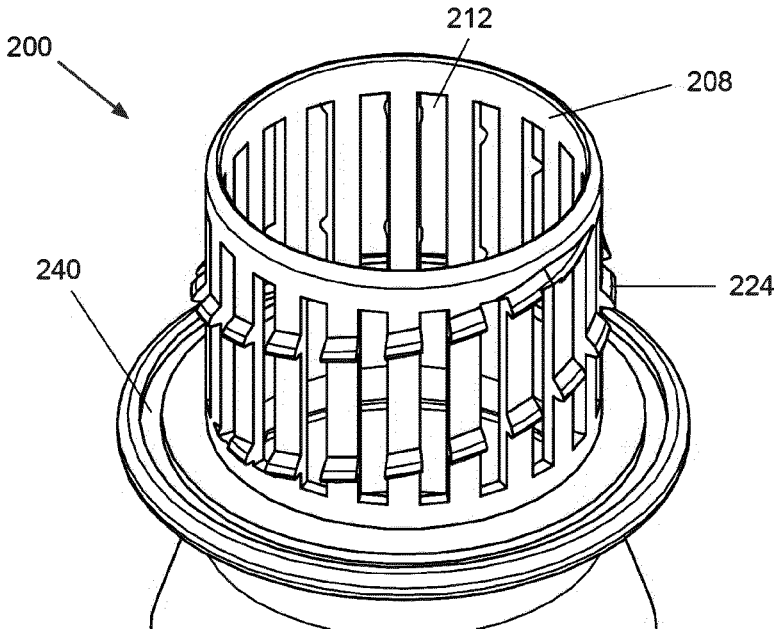
FIG. 23 is a schematic illustration of an exemplary threaded neck in which the neck thread support member has numerous discrete recesses that are rectangular fenestrations.
Figure 24:
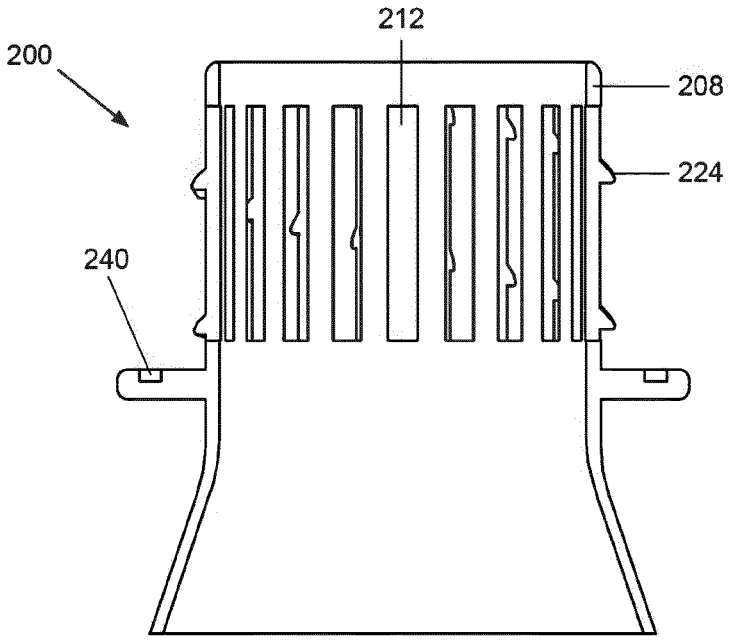
FIG. 24 is a cross-sectional view of the exemplary threaded neck of FIG. 23.

FIG. 24 is a cross-sectional view of the exemplary threaded neck of FIG. 23. The thread (224) on the neck thread support member (208) is interrupted.

With the practices of a skilled person, the invention envisages variations including but not limited to number, size, material, shape, color, placement and placement relative to other components of all the components of the invention including but not limited to the top wall, thread support member or a subregion thereof, thread, and discrete recess of the thread support member or a subregion thereof.

With the practices of a skilled person, the invention envisages variations including but not limited to number, size, material, shape, color, placement and placement relative to other components or all the components of the invention including but not limited to the lip, the spout, the nozzle, the pipe, the tube, the hose, the venting tube, the air flow channel, the partitioning body, the indication element, the stop element, the receiving neck, the receiving neck thread support member or a subregion thereof, the receiving neck thread, the discrete recess of the neck thread support member or a subregion thereof, the fenestration of the neck thread support member or a subregion thereof.

Embodiments of the invention may have additional components or properties including but not limited to gripping protrusions, gripping handles and longitudinally protruding handles.

Embodiments of the invention may have additional components or properties including but not limited to a lip, a spout, a nozzle, a pipe, a tube, a hose, a venting tube, an air flow channels, a partitioning body, an indication element and a stop element.

The invention is equally applicable for closures which have an internal or external thread on the thread support member.

The discrete recesses can be limited to the thread support member, but can also extend to a part of the thread, or can comprise the entire width of the thread.

The discrete recesses can be open-ended or close-ended, by which is meant that a discrete recesses does not have to be bound by the respective thread support member wall.

The term "recess" preferably means that a part of the thickness of the thread support member has effectively been removed; it does not mean that a recess is created by raising adjacent parts of the wall.

The invention claimed is:

1. A closure comprising:

a top wall portion, and a thread support member extending from said top wall portion disposed with a thread, and either:

at least one discrete recess provided on said thread support member, wherein:

said discrete recess extends below a surface of and through said thread support member so as to form a fenestration, wherein said fenestration is configured for passage of flowable matter, and said thread support member is provided with a subregion limited by ends of said thread, wherein said discrete recess is provided at least partially within said subregion, and said discrete recess formed as a fenestration is further formed as a three-dimensional marking, wherein the three-dimensional marking is an alphanumeric, or a pictorial, or a portrayal of communication, or a graphic, wherein the graphic:

does not have reflection symmetry, or has a border, wherein the border has only three edges, or wherein the border has at least three edges, and at least a part of each said edges is not parallel to the top wall, or wherein at least a part of the border is a curve, or at least two discrete recesses provided on said thread support member, wherein:

said discrete recesses extend below a surface of and through said thread support member so as to form fenestrations, wherein said fenestrations are configured for passage of flowable matter, and said discrete recesses are each disposed at a different axial position on the thread support member relative to the top wall portion.

2. Closure according to claim 1, wherein said at least one discrete recess formed as a fenestration is configured to reduce the weight of said closure without a decrease of function of said thread support member.

3. Closure according to claim 1, wherein the thread is disposed on an inner surface of said thread support member.

4. Closure according to claim 1, wherein said at least one discrete recess formed as a fenestration is configured to increase grip.

5. Closure according to claim 1, wherein the thread is disposed on an outer surface of said thread support member.

6. Closure according to claim 1, wherein the closure further comprises a manipulation element disposed on said top wall portion, configured for the application of torque.

7. Closure according to claim 1, wherein at least part of the thread is continuous in and of itself and transverses a fenestration, configured to contribute to the mechanical strength of said thread support member.

8. Closure according to claim 1, wherein said three-dimensional marking is configured for visual and/or tactile identification.

9. Closure according to claim 1, wherein said at least one discrete recess formed as a fenestration is configured to decrease the required torque for said closure.

10. Closure according to claim 1, wherein said at least one discrete recess formed as a fenestration is configured to allow direct visibility of said thread.

11. Closure according to claim 1, wherein said at least one discrete recess formed as a fenestration is configured for gradual control of content flow.

12. Closure according to claim 1, wherein said at least one discrete recess formed as a fenestration is configured as a flow modifier.

13. Closure according to claim 1, wherein said at least one discrete recess formed as a fenestration is configured as a particle filter.

14. Closure according to claim 1, wherein said at least one discrete recess formed as a fenestration is configured to improve the heat dissipation capacity of the closure.

15. Closure according to claim 1, formed substantially from a polymeric material.

16. Closure according to claim 1, wherein said closure is for an artefact such as a container, and said top wall portion is configured to sealingly co-operate with an opening of the artefact.

17. Closure according to claim 1, wherein the quantity of discrete recesses formed as fenestrations provided at least partially optionally fully within the subregion is 1-5, 1-100, 5-30, 10-20, more than or equal to 12, preferably 1-40.

18. A closure comprising:
a top wall portion, and
a thread support member extending from said top wall portion disposed with a thread, and either:
at least one discrete recess provided on said thread support member, wherein:
said discrete recess extends below a surface of said thread support member, and
said discrete recess is formed as a three dimensional marking,
wherein the three-dimensional marking is an alphanumeric, or a pictorial, or a portrayal of communication, or a graphic,
wherein the graphic:
does not have reflection symmetry, or
has a border,
wherein the border has only three edges, or
wherein the border has at least three edges, and at least a part of each said edges is not parallel to the top wall, or
wherein at least a part of the border is a curve, or
at least two discrete recesses provided on said thread support member, wherein:
said discrete recesses extend below a surface of said thread support member, and
said discrete recesses are each disposed at a different axial position on the thread support member relative to the top wall portion.

19. Closure according to claim 18, wherein said at least one discrete recess formed as a three dimensional marking is configured for visual and/or tactile identification.

20. Closure according to claim 18, wherein said at least one discrete recess is configured to reduce the weight of said closure without a decrease of function of said thread support member.

21. Closure according to claim 18, wherein the thread is disposed on an inner surface of said thread support member.

22. Closure according to claim 18, wherein said at least one discrete recess is configured to increase grip.

23. Closure according to claim 18, wherein the thread is disposed on an outer surface of said thread support member.

24. Closure according to claim 18, wherein the closure further comprises a manipulation element disposed on said top wall portion, configured for the application of torque.

25. Closure according to claim 18, wherein the at least one discrete recess is configured to decrease the required torque for said closure.

26. Closure according to claim 18, formed substantially from a polymeric material.

27. Closure according to claim 18, wherein said closure is for an artefact such as a container, and said top wall portion is configured to sealingly cooperate with an opening of the artefact.

28. Closure according to claim 18, wherein the thread support member is provided with a subregion limited by ends of the thread wherein the at least one discrete recess formed as a three-dimensional marking is provided at least partially within the subregion.

* * * * *